US011098686B2

(12) United States Patent
Itaya et al.

(10) Patent No.: US 11,098,686 B2
(45) Date of Patent: Aug. 24, 2021

(54) FUEL INJECTION VALVE

(71) Applicant: Hitachi Automotive Systems, Ltd., Hitachinaka (JP)

(72) Inventors: Takaki Itaya, Hitachinaka (JP); Tomoyuki Hosaka, Tokyo (JP); Noriyuki Maekawa, Hitachinaka (JP); Takao Miyake, Hitachinaka (JP)

(73) Assignee: Hitachi Automotive Systems, Ltd., Hitachinaka (JP)

( * ) Notice: Subject to any disclaimer, the term of this patent is extended or adjusted under 35 U.S.C. 154(b) by 178 days.

(21) Appl. No.: 16/609,256

(22) PCT Filed: Apr. 19, 2018

(86) PCT No.: PCT/JP2018/016083

§ 371 (c)(1),
(2) Date: Oct. 29, 2019

(87) PCT Pub. No.: WO2018/207582

PCT Pub. Date: Nov. 15, 2018

(65) Prior Publication Data

US 2020/0049118 A1 Feb. 13, 2020

(30) Foreign Application Priority Data

May 12, 2017 (JP) ..... JP2017-095217

(51) Int. Cl.
*F02M 61/18* (2006.01)
*F02M 51/06* (2006.01)
*F02M 61/14* (2006.01)

(52) U.S. Cl.
CPC ..... *F02M 61/1833* (2013.01); *F02M 51/06* (2013.01); *F02M 51/061* (2013.01);
(Continued)

(58) Field of Classification Search
CPC .. F02M 61/18; F02M 61/184; F02M 61/1806; F02M 61/1813; F02M 61/182; F02M 61/1833; F02M 61/1846
See application file for complete search history.

(56) References Cited

U.S. PATENT DOCUMENTS 3,687,375 A * 8/1972 Griffiths ..... F02M 61/02 239/557
5,156,130 A * 10/1992 Soma ..... F02M 69/044 123/472

(Continued)

FOREIGN PATENT DOCUMENTS

JP 2007-315276 A 12/2007
JP 2011-220247 A 11/2011

(Continued)

OTHER PUBLICATIONS

International Search Report (PCT/ISA/210) issued in PCT Application No. PCT/JP2018/016083 dated Jul. 10, 2018 with English translation (four (4) pages).

(Continued)

*Primary Examiner* — Thomas N Moulis
(74) *Attorney, Agent, or Firm* — Crowell & Moring LLP

(57) ABSTRACT

An object of the present invention is to provide a fuel injection valve that can be used in a gasoline engine and can take fuel into an injection hole with a small pressure loss near a seat portion on which a valve is seated. Thus, the present invention provides a fuel injection valve for a gasoline engine which includes: a plurality of injection holes; and a seat portion that opens and closes a fuel passage to the plurality of injection holes in cooperation with a valve. At least one fuel injection hole among the plurality of injection holes is configured in a shape such that an injection hole inlet has a long axis and a short axis, and the long axis (Continued)

is directed in a direction in which an extension line intersects with the seat portion.

11 Claims, 25 Drawing Sheets

(52) U.S. Cl.
CPC ..... *F02M 61/14* (2013.01); *F02M 61/184* (2013.01); *F02M 61/1806* (2013.01); *F02M 61/1846* (2013.01); *F02M 61/18* (2013.01)

(56) References Cited

U.S. PATENT DOCUMENTS

| | | | | |
|---|---|---|---|---|
| 6,105,883 | A * | 8/2000 | Takeda | F02M 61/184 239/463 |
| 10,280,885 | B2 * | 5/2019 | Sumida | F02M 61/162 |
| 2010/0320293 | A1 * | 12/2010 | Ogura | F02M 61/1846 239/533.12 |
| 2011/0215177 | A1 | 9/2011 | Guerrassi et al. | |
| 2012/0292409 | A1 * | 11/2012 | Bignion | F02M 61/1873 239/533.2 |
| 2014/0183286 | A1 * | 7/2014 | Chazono | F02M 63/0033 239/584 |
| 2015/0377200 | A1 | 12/2015 | Abe et al. | |
| 2015/0377202 | A1 | 12/2015 | Ishii et al. | |
| 2018/0355832 | A1 * | 12/2018 | Yi | F02M 61/1813 |
| 2018/0363615 | A1 | 12/2018 | Yasukawa et al. | |
| 2019/0093617 | A1 * | 3/2019 | Niwa | F02M 61/1886 |
| 2020/0182212 | A1 * | 6/2020 | Matsuzawa | F02M 63/0077 |
| 2020/0318594 | A1 * | 10/2020 | Schnobrich | F02M 61/1853 |
| 2021/0123403 | A1 * | 4/2021 | Niwa | F02M 61/1833 |

FOREIGN PATENT DOCUMENTS

| | | | |
|---|---|---|---|
| JP | 2012-508845 | A | 4/2012 |
| JP | 2013-87757 | A | 5/2013 |
| JP | 2014-148954 | A | 8/2014 |
| JP | 2014-148955 | A | 8/2014 |
| JP | 2014-208991 | A | 11/2014 |
| JP | 2016-98785 | A | 5/2016 |
| JP | 2016-183676 | A | 10/2016 |

OTHER PUBLICATIONS

Japanese-language Written Opinion (PCT/ISA/237) issued in PCT Application No. PCT/JP2018/016083 dated Jul. 10, 2018 (four (4) pages).

* cited by examiner

FUEL INJECTION VALVE

TECHNICAL FIELD

The present invention relates to a fuel injection valve.

BACKGROUND ART

A fuel injection nozzle described in JP 2016-98785 A (PTL 1) is known as a fuel injection valve mounted on an internal combustion engine that directly injects fuel into a combustion chamber.

PTL 1 describes that a hole diameter of an injection hole inlet is set to be larger than a hole diameter of an injection hole outlet in order to increase a flow rate coefficient of an injection hole and that an opening cross section of the injection hole inlet is formed into a long hole shape having a short axis and a long axis in order to prevent a situation where it is difficult to maintain strength of an inner wall on a nozzle seat (seat portion) side on which a valve portion (valve) is seated due to a short distance between adjacent injection holes (see Paragraphs 0004 and 0009). Further, PTL 1 describes that a long-axis direction of the long hole shape is set to be inclined by a predetermined angle in the same (rotation) direction as swirl flow with respect to a nozzle central-axis direction in order to reduce a variation range in an injection direction of fuel spray injected into the combustion chamber (see Paragraphs 0009 and 0010). The fuel injection nozzle of PTL 1 is used for a diesel engine, the valve portion (valve) has a first seal surface and a second seal surface whose outer diameter gradually decreases toward a distal end to form a conical surface, and an inclination (taper) angle of the second seal surface is steeper than an inclination (taper) angle of the first seal surface (see Paragraphs 0015 and 0030). In the fuel injection nozzle of PTL 1, an annular intersecting ridge line (a first seat line) formed between the first seal surface and the second seal surface functions as an annular nozzle seal that adheres closely to a nozzle seat of a nozzle body (nozzle member), and the injection hole inlet is configured to be covered with the second seal surface on the downstream side of the nozzle seal in a fuel flow direction (see Paragraphs 0030 and 0060 and FIGS. 9 and 10).

Meanwhile, a fuel injection valve described in JP 2016-183676 A (PTL 2) is known as a fuel injection valve mounted on an internal combustion engine for gasoline that directly injects fuel into a combustion chamber.

The fuel injection valve of PTL 2 includes a member provided with a fuel injection hole and a valve that contacts or separates from a valve seat, and is configured such that a round chamfered portion is formed at an opening edge of an injection hole inlet, and a cross-sectional area parallel to an opening of the injection hole inlet is smaller from the injection hole inlet toward an injection hole outlet.

With the above configuration, this fuel injection valve prevents peeling of fuel that occurs inside the injection hole and suppresses adhesion of fuel to an intake valve and a cylinder inner wall surface (combustion chamber inner wall surface) at the time of injection into the cylinder (into the combustion chamber) (see the Abstract and Paragraph 0036). Further, in the fuel injection valve of PTL 2, the injection hole inlet is open at a portion where an interval (gap) between the valve and the valve seat surface is enlarged (see FIG. 2).

CITATION LIST

Patent Literature

PTL 1: JP 2016-98785 A
PTL 2: JP 2016-183676 A

SUMMARY OF INVENTION

Technical Problem

The fuel injection valve of PTL 2 is applied to a gasoline engine and has the round chamfered portion at the opening edge of the injection hole inlet. This fuel injection valve suppresses peeling of fuel inside the injection hole by providing the round chamfered portion. In this fuel injection valve, however, the injection hole has a circular cross section, and there is no sufficient consideration to take fuel into the injection hole with a small pressure loss in the vicinity of the valve seat (seat portion).

Further, the fuel injection nozzle of PTL 1 is the fuel injection valve for the diesel engine, and the opening cross section of the injection hole inlet is formed in the long hole shape having the short axis and the long axis in order to prevent the situation where it is difficult to maintain the strength of the inner wall on the nozzle seat (seat portion) side on which the valve portion (valve) is seated, but there is no consideration to take fuel into the injection hole with a small pressure loss in the vicinity of the nozzle seat.

An object of the present invention is to provide a fuel injection valve that can be used in a gasoline engine and can take fuel into an injection hole with a small pressure loss near a seat portion on which a valve is seated.

Solution to Problem

In order to solve the above object, a fuel injection valve of the present invention is a fuel injection valve for a gasoline engine which includes:

a plurality of injection holes; and a valve and a seat portion that open and close a fuel passage to the plurality of injection holes in cooperation with each other. At least one fuel injection hole among the plurality of injection holes is configured in a shape such that an injection hole inlet has a long axis and a short axis, and the long axis is directed in a direction in which an extension line intersects with the seat portion.

Advantageous Effects of Invention

According to the fuel injection valve for the gasoline engine of the present invention, it is possible to take fuel into the injection hole with a small pressure loss in the vicinity of the seat portion on which the valve is seated and to keep a fuel pressure inside the injection hole high, and thus, it is possible to suppress spread of spray in the vicinity of the injection hole outlet and to suppress adhesion of fuel to the vicinity of the injection hole outlet. Accordingly, it is possible to provide the fuel injection valve that can suppress generation of a suspended particulate matter and improve exhaust performance. Other objects, configurations, and effects which have not been described above become apparent from embodiments to be described hereinafter.

DESCRIPTION OF EMBODIMENTS

Hereinafter, embodiments of a fuel injection valve according to the present invention will be described in detail with reference to the drawings. In the following description, a configuration which is common in the respective embodiments will be denoted by the same reference sign, and the overlapping description thereof will be omitted. Further, even if the configuration is denoted by the same reference sign, a different part from other embodiments will be described each time.

Figure 27:
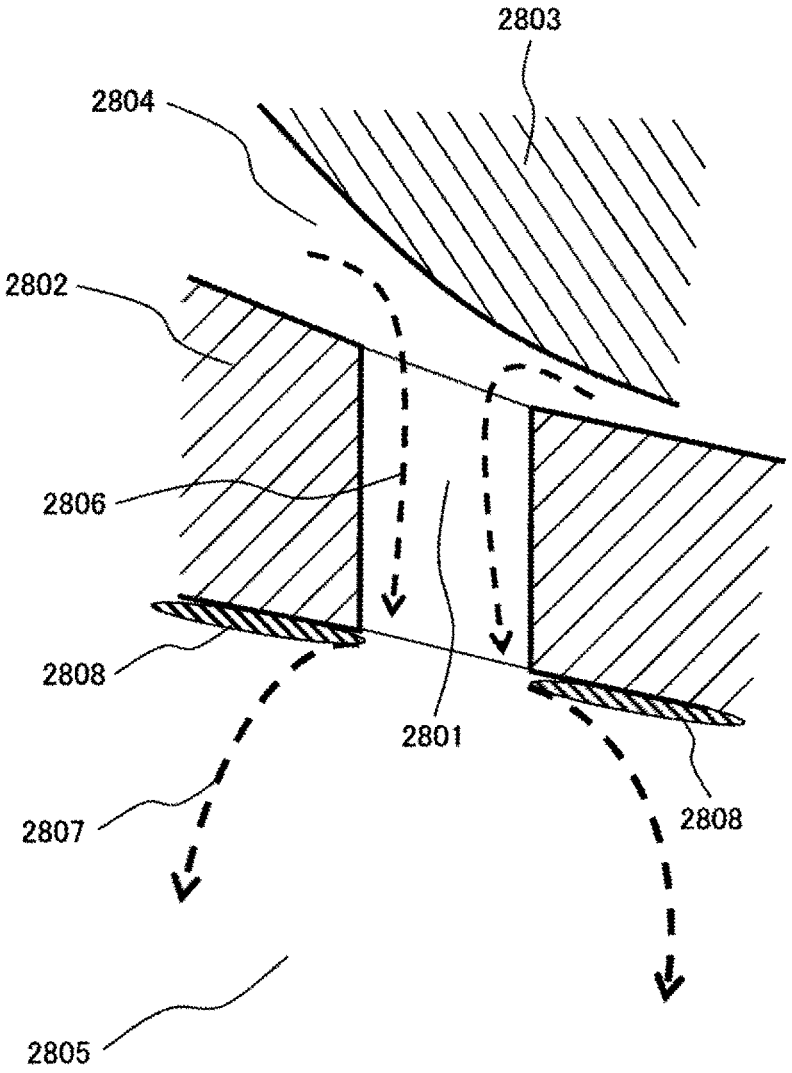
FIG. 27 is a conceptual view illustrating spread of fuel spray and adhesion of fuel to the vicinity of an injection hole outlet.

First, spread of fuel spray and adhesion of fuel to the vicinity of an injection hole outlet will be described with reference to FIG. 27. FIG. 27 is a conceptual view illustrating the spread of fuel spray and the adhesion of fuel to the vicinity of the injection hole outlet. FIG. 27 illustrates a cross section of one injection hole among a plurality of injection holes of a fuel injection valve.

Reference sign 2801 denotes an injection hole, 2802 denotes a member (injection hole constituting member) constituting an injection hole, and 2803 denotes a valve. A fuel passage 2804 is constituted by the injection hole constituting member 2802 and the valve 2803. Reference sign 2805 denotes a combustion chamber of an internal combustion engine to which fuel is injected from the injection hole 2801. Flow of fuel passing through the fuel passage 2804 is denoted by 2806. Fuel flowing out from the injection hole 2801 is denoted by 2807, and 2808 denotes fuel adhering to the vicinity of the injection hole 2801. Specifically, in the case of describing flow of fuel, when the fuel flows from an upstream side of the fuel passage 2804, the fuel flows into the injection hole 2801 with a pressure loss as indicated by the flow 2806. At that time, the fuel further flows as indicated by the flow 2807 with a pressure loss through the injection hole 2801 and flows out into the combustion chamber 2805 as spray. At that time, when the pressure (atmospheric pressure) of the combustion chamber 05, which is a pressure of a field where injection is performed, is low, the fuel adheres to the periphery of an injection hole outlet as indicated by 2808 due to the spread of the spray, and the adhering fuel spreads to wet the periphery of the injection hole outlet. As the adhering fuel is exposed to high-temperature and high-pressure combustion inside the combustion chamber. As a result, the adhering fuel is deposited as a deposit and absorbs fuel at each injection, and becomes a starting point of generation of a suspended particulate matter.

Hereinafter, the spread of the spray is suppressed, and the adhesion of fuel to the vicinity of the injection hole outlet is suppressed.

One embodiment of a fuel injection valve 101 to which the present invention is applied will be described with reference to the drawings. The fuel injection valve 101 is common to a plurality of embodiments to be described later.

Figure 1:
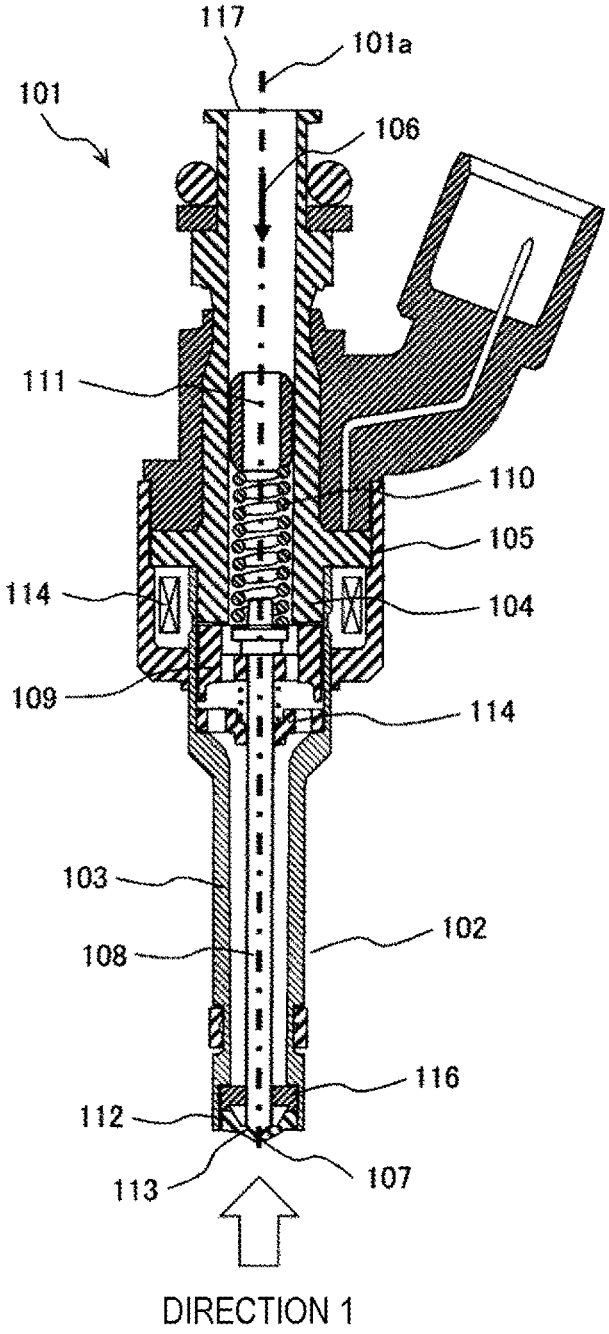
FIG. 1 is a configuration view of a fuel injection valve according to the present invention.

First, a configuration of the fuel injection valve 101 will be described with reference to FIG. 1. FIG. 1 is a configuration view of the fuel injection valve according to the present invention. Incidentally, the fuel injection valve of the present invention is not limited to the configuration of the fuel injection valve illustrated in FIG. 1.

Although a description is sometimes given by designating an up-and-down direction in the following description, the up-and-down direction is defined based on FIG. 1, and a proximal end side of the fuel injection valve 101 provided with a fuel supply port 117 is defined as the upper side, and a distal end side of the fuel injection valve 101 provided with a fuel injection hole 107 (hereinafter referred to as an injection hole) is defined as the lower side. This up-and-down direction does not necessarily match an up-and-down direction in a mounting state of the fuel injection valve 101.

In the fuel injection valve 101, a valve body 102 includes a nozzle holder 103, a core (fixed core) 104, and a housing 105. A nozzle member (nozzle body) 112 is fixed to a distal end portion of the nozzle holder 103, and a plurality of injection holes 107 and a seat portion 113 are formed in the nozzle member 112.

Fuel from a high-pressure fuel pump (not illustrated) is sent to the plurality of injection holes 107 through the fuel passage 106 and discharged from the injection holes 107 to the outside of the fuel injection valve 101.

A valve 108 is accommodated in the nozzle holder 103 so as to be slidable in an axial direction (direction of a central axis 101*a*) via an anchor (movable core) 109. A spring 110 is arranged between the valve 108 and an adjuster pin 111, and a position of an upper end portion of the spring 110 is restrained by the adjuster pin 111. The spring 110 biases the valve 108 in a direction in which the valve 108 is pressed against the seat portion 113 (valve closing direction), the valve 108 contacts the seat portion 113 when a solenoid 114 is not energized, and a valve portion (fuel passage) constituted by the valve 108 and the seat portion 113 is closed.

The solenoid 114 is arranged on an upper portion and on an outer circumferential side of the anchor 109, and a drive current is supplied to the solenoid 114 from a drive circuit (not illustrated). When the solenoid 114 is energized, the core 104 is excited to generate a magnetic attractive force in the anchor 109, and the anchor 109 is pulled up in an axial direction toward the core 104. Accordingly, the valve 108 is pulled up in the axial direction by the anchor 109. At this time, the valve 108 separates from the seat portion 113, and the valve portion constituted by the valve 108 and the seat portion 113 is opened. The valve 108 is configured so as to be slidable with respect to guides 115 and 116, and movement in the valve opening/closing direction is guided by the guides 115 and 116. Then, the plurality of injection holes 107 are opened, and fuel pressurized and pumped by the high-pressure fuel pump (not illustrated) is injected from the injection holes 107.

Hereinafter, embodiments according to the present invention will be described in detail.

First Embodiment

A first embodiment of the present invention will be described with reference to FIGS. 2 to 7.

Figure 2:
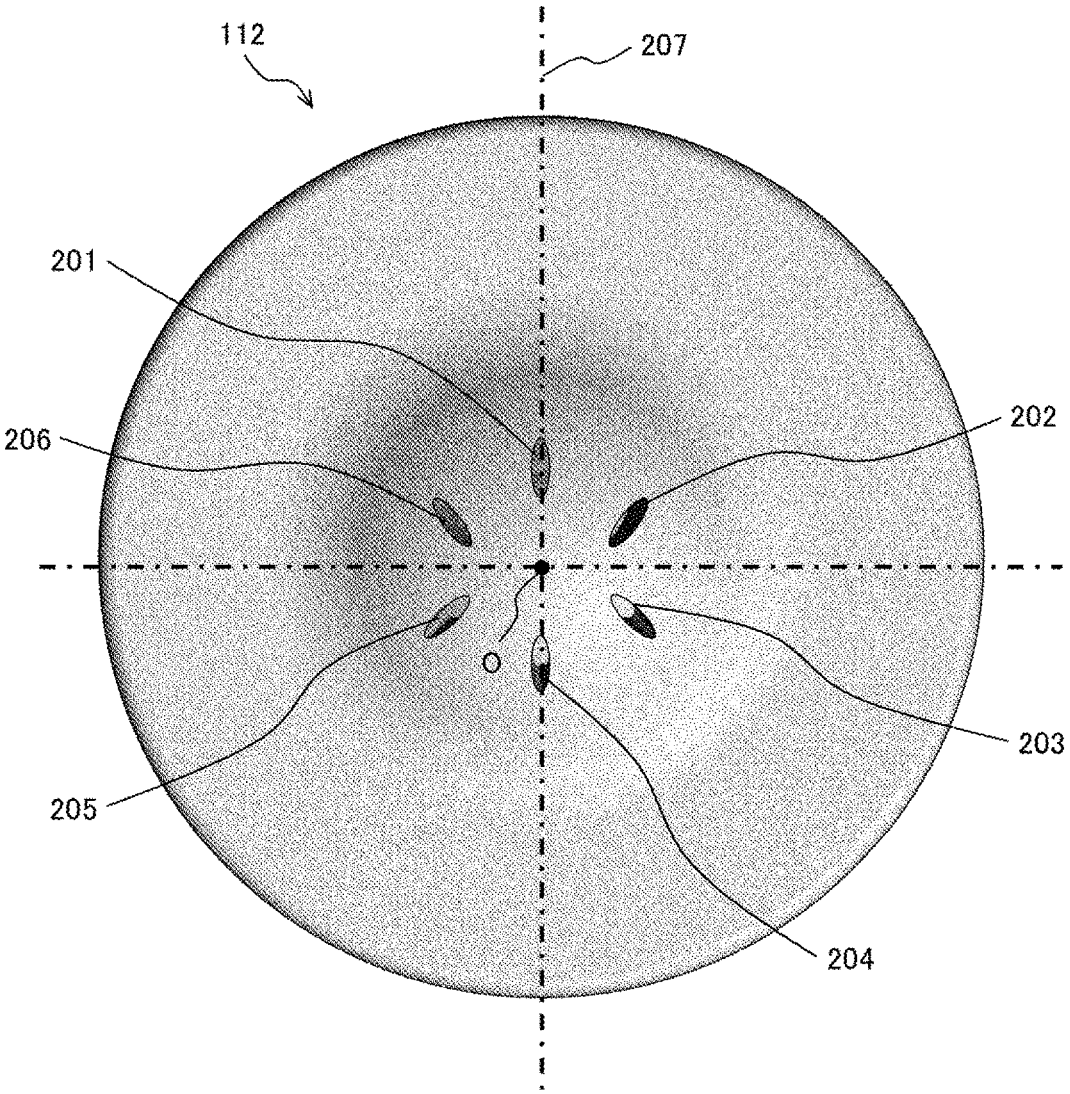
FIG. 2 is a plan view illustrating a configuration of an injection hole outlet of the fuel injection valve according to a first embodiment.

FIG. 2 is a plan view illustrating a configuration of an injection hole outlet of a fuel injection valve according to the first embodiment. FIG. 2 illustrates the injection hole outlet side of the nozzle member 112, and is the view as seen from a direction 1 in FIG. 1.

Reference signs 201, 202, 203, 204, 205, and 206 denote outlet-side openings of injection holes (hereinafter referred to as injection hole outlets), and six injection holes are provided in the present embodiment. The number of injection holes of the present invention is not limited to six.

The injection hole outlets 201, 202, 203, 204, 205, and 206 will be described using an elliptical shape in order to simplify the description, but do not necessarily have the elliptical shape as long as a shape has a long axis and a short axis. Further, the injection hole outlets 201, 202, 203, 204, 205, and 206 are arranged to be line-symmetric with respect to a center line 207 of the nozzle member 112 in the present embodiment, but are not necessarily arranged to be symmetric. Incidentally, the center line 207 is a line segment that passes through a center O of the nozzle member 112 and is perpendicular to the central axis 101*a* of the fuel injection valve 101.

Figure 26:
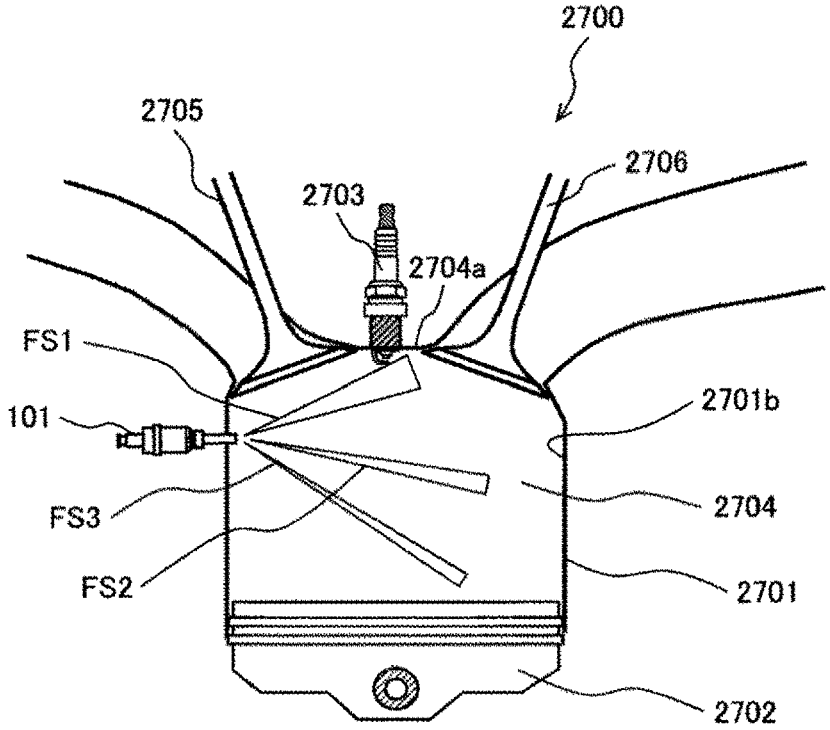
FIG. 26 is a cross-sectional view illustrating a state where the fuel injection valve according to the present invention is mounted on an internal combustion engine.

Here, a description will be given with reference to FIG. 26 regarding an attachment state of the fuel injection valve 101 with respect to an internal combustion engine and an arrangement of fuel spray injected from the fuel injection valve 101 to a combustion chamber of the internal combustion engine. FIG. 26 is a cross-sectional view illustrating a state where the fuel injection valve according to the present invention is mounted on the internal combustion engine.

An internal combustion engine 2700 includes: a cylindrical cylinder 2701; a piston 2702 that reciprocates in the cylinder 2701; a spark plug 2703 arranged on a top (cylinder head) 270*a* of the cylinder 2701; a combustion chamber 2704 that burns fuel; an intake valve 2705 that takes air into the combustion chamber 2704; and an exhaust valve 2706 that exhausts a burned gas. The combustion chamber 2704 is formed in a space surrounded by the cylinder head 270*a*, a side wall 2701*b* of the cylinder 2701, and a crown surface 2702*a* of the piston 2702. Further, the fuel injection valve 101 is attached to the side wall 2701*b* of the cylinder 2701 such that a distal end portion of the fuel injection valve 101 faces the inside of the combustion chamber 2704 in the present embodiment.

The injection hole outlet 201 is configured by an injection hole that injects spray FS1 in a direction closest to the spark plug 2703 when injecting fuel into the combustion chamber 2701, the injection hole outlets 202, 203, 205, and 206 are arranged to inject spray FS2 for spreading the spray throughout the entire combustion chamber, and the injection hole outlet 204 is configured by an injection hole that injects spray FS3 closest to the piston 2702 of the combustion chamber 2701.

The injection hole outlet 201 to inject the spray FS1 is arranged on the spark plug side such that the spray FS1 is directed toward the spark plug. The injection hole outlet 204 to inject the spray FS3 is arranged on the piston side so as to be directed toward the piston. The injection hole outlets 202 and 206 out of the injection hole outlets to inject the spray FS2 are arranged on the spark plug side with respect to the injection hole outlets 203 and 205 such that the spray is directed toward the spark plug. The injection hole outlets 203 and 205 out of the injection hole outlets to inject the spray FS2 are arranged on the piston side with respect to the injection hole outlets 202 and 206 such that the spray is directed toward the piston.

As described above, it is desirable to set the respective injection directions in accordance with combustion chamber shapes that are different for each internal combustion engine. Further, it is desirable to adjust a cross-sectional area of the injection hole outlet by distributing a flow rate in a desired direction of the injection, and a ratio of lengths of the long axis and the short axis may be adjusted by the injection hole.

Figure 3:
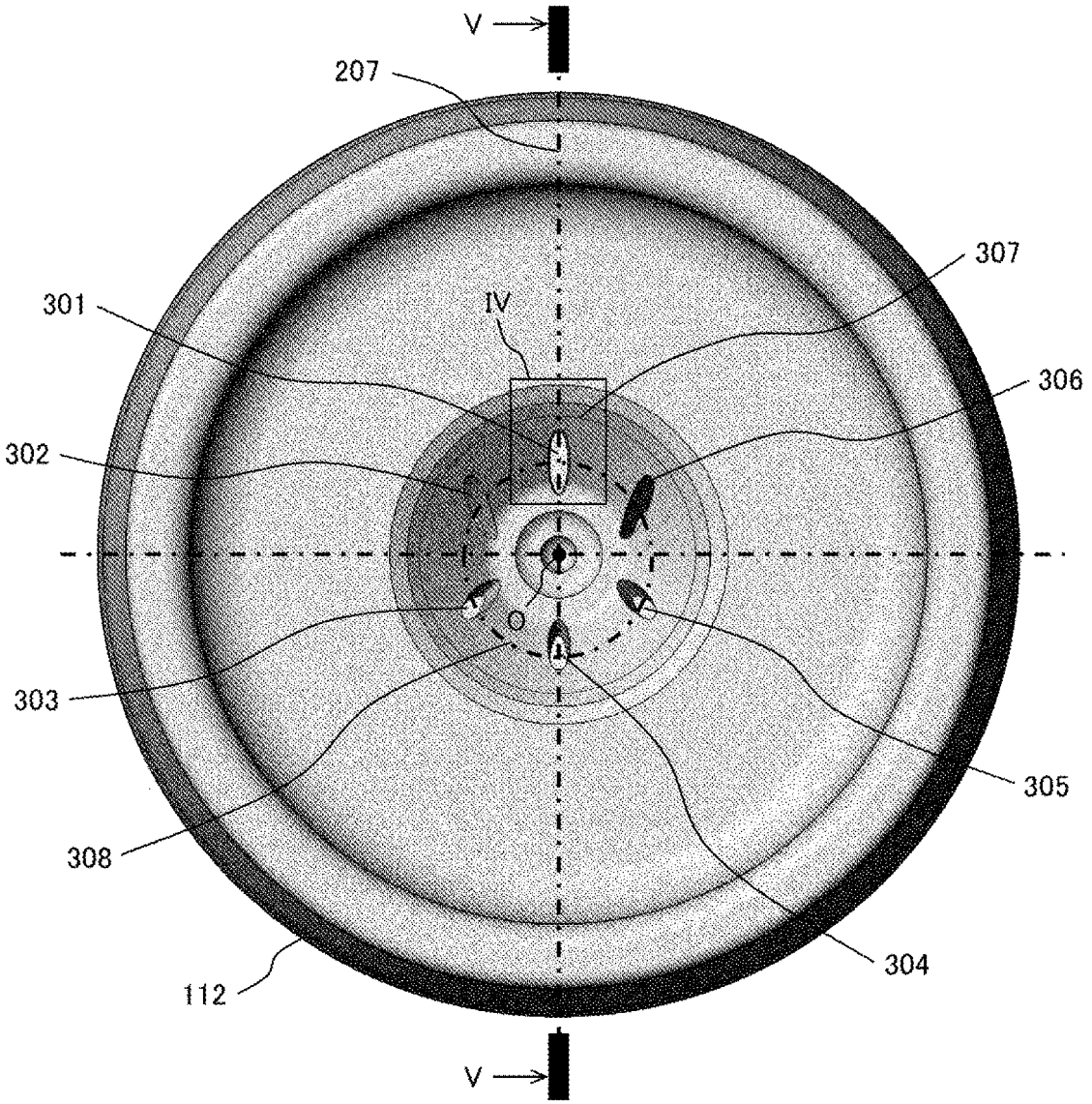
FIG. 3 is a plan view illustrating a configuration of an injection hole inlet according to the first embodiment.

Subsequently, a structure on the fuel inlet side of the injection hole in the fuel injection valve 101 will be described with reference to FIG. 3. FIG. 3 is a plan view illustrating a configuration of the injection hole inlet according to the first embodiment. FIG. 3 is the view of the nozzle member 112 as seen from the inner side of the fuel injection valve 101 in an opposite direction of FIG. 2, and the valve 108 is not illustrated in order for the easy description of the injection hole.

An injection hole 301 indicates an inlet-side opening (hereinafter referred to as an injection hole inlet) on a fuel upstream side of the injection hole outlet 201 in FIG. 2. Similarly, 302, 303, 304, 305, and 306 also indicate injection hole inlets on the upstream side of the respective injection hole outlets 202, 203, 204, 205, and 206 in FIG. 2. Reference sign 307 denotes a seat portion of the valve 108, which is similar to reference sign 113 in FIG. 1. Reference sign 308 denotes a virtual circle passing through the centroid of each injection hole inlet.

The respective injection hole inlets 301 to 306 are formed into a shape having a long axis and a short axis similarly to the injection hole outlets 201 to 206, and the injection hole is open so as to extend in a direction of the seat portion 307 from the center O side of the nozzle member 112. That is, each long axes of the injection hole inlets 301 to 306 is directed in a direction in which an extension line thereof intersects with the seat portion 307. As a result, the long axis of the injection hole inlet is arranged along a radiation direction (radial direction) centered on O of the nozzle member 112. The injection hole inlets 301 to 306 are formed in an elliptical shape similarly to the injection hole outlets 201 to 206, but do not necessarily have the elliptical shape as long as a shape has a long axis and a short axis.

In the present embodiment, the injection hole inlets 301 to 306 are arranged to be line-symmetric with respect to the center line 207 of the nozzle member 112, but it is unnecessary to arrange the injection hole inlets 301 to 306 to be line-symmetric with respect to the center line 207 as long as the long axes of the injection holes are arranged as described above. Further, it is unnecessary to arrange all the injection hole inlets 301 to 306 as described above, and the respective injection hole inlets 301 to 306 may be arranged such that a long axis extends in the seat direction from the center O side of the nozzle member 112 while being limited to a hole where a pressure in the injection hole is low.

In the following description, injection holes will be designated using reference signs 301, 302, 303, 304, 305, and 306 of the injection hole inlets. For example, an injection hole having the injection hole inlet 301 and the injection hole outlet 201 will be described as the injection hole 301.

Figure 4:
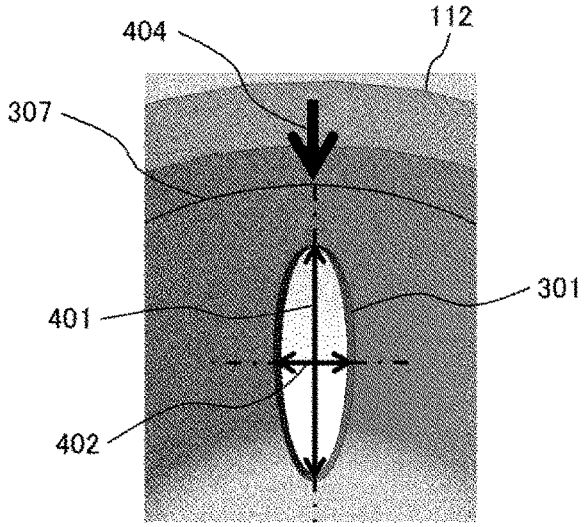
FIG. 4 is a partially enlarged view (a partially enlarged view of a portion IV of FIG. 3) illustrating the injection hole inlet according to the first embodiment in an enlarged manner.

Next, the injection hole will be described in more detail with reference to FIG. 4. FIG. 4 is a partially enlarged view (a partially enlarged view of a portion IV of FIG. 3) illustrating the injection hole inlet according to the first embodiment in an enlarged manner. Incidentally, FIG. 4 is the enlarged view of the vicinity of the injection hole inlet 301.

The injection hole inlet 301 has a long axis 401 and a short axis 402, and is configured such that the long axis is directed in a direction of the seat portion 307. The long axis 401 and the short axis 402 are configured in the same direction from the injection hole inlet 301 to the injection hole outlet 201. That is, a transverse cross section of the injection hole 301 (a cross section perpendicular to a central axis of the injection hole) has the long axis 401 and the short axis 402. The other injection holes 302 to 306 also have the long axis 401 and the short axis 402 similarly to the injection hole 301.

The injection hole 301 and the injection hole 304 are arranged such that the direction of the long axis 401 coincides with the radiation direction (radial direction) centered on O in the plan view of FIG. 3 (the view projected on a virtual plane perpendicular to the central axis 101*a*). On the other hand, the direction of the long axis 401 is inclined with respect to the radiation direction (radial direction) centered on O in the injection hole inlets 302, 303, 305, and 306. However, the long axes 401 of the injection hole inlets 302, 303, 305, and 306 are not perpendicular to a virtual line segment, which passes through the center O of the nozzle member and centers of the injection hole inlets 302, 303, 305, and 306 and extends in the radiation direction, but are inclined with respect to the virtual line segment.

An arrow 404 indicates flow of fuel on the upstream side of the seat portion 307, the fuel is supplied to the injection hole 301 while being accompanied by a pressure loss caused by a flow resistance from the upstream side of the injection hole inlet 301 to the injection hole inlet 301, and a large pressure loss is accompanied particularly at the time of passing the seat portion 307.

In the present embodiment, the injection hole inlets 301 to 306 are configured to be open up to the vicinity of the seat 307 by arranging the long axes 401 as described above. As a result, the injection hole inlets 301 to 306 can shorten the upstream fuel passage and reduce the pressure loss. Thus, the fuel can be guided to the injection holes 301 to 306 with a high pressure.

In the present embodiment, it is desirable that centroids of at least two of the injection holes 301 to 306 be arranged on the same circle. As a result, fuel is evenly distributed to each of the injection holes arranged on the same circle so that a difference in pressure in the injections is eliminated, and it is possible to prevent a pressure of a specific injection hole from decreasing. Then, the spread of spray in the vicinity of the injection hole outlet can be suppressed, and it is possible to effectively suppress wetting and spread of fuel on the outer surface of the injection hole outlet. In particular, the centroids of the injection hole inlets 301 to 306 are arranged on the virtual circle 308 in all the injection holes in the present embodiment.

Figure 5:
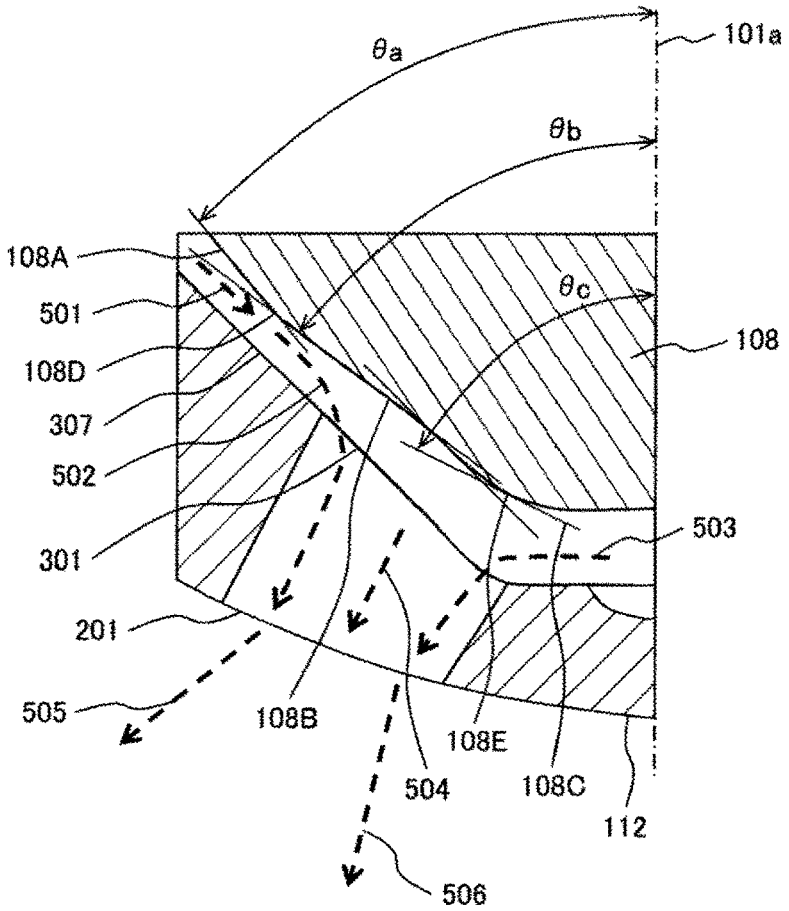
FIG. 5 is a cross-sectional view of the vicinity of an injection hole according to the first embodiment (an enlarged view of the vicinity of the injection hole in a V-V cross section of FIG. 3).

Next, fuel flow will be specifically described with reference to FIG. 5. FIG. 5 is a cross-sectional view of the vicinity of the injection hole according to the first embodiment (an enlarged view of the vicinity of the injection hole in a V-V cross section of FIG. 3). Although the injection hole 301 will be described with reference to FIG. 5, the same effect can be obtained with the other injection holes 302 to 306 although there is a difference in magnitude of the effect.

The fuel injection valve 101 of the present embodiment is a fuel injection valve for a gasoline engine, and the valve 108 has a first conical surface (first truncated cone surface) 108A and a second conical surface (second truncated cone surface) 108B. The first conical surface 108A is positioned on the upstream side of the second conical surface 108B in a direction in which fuel flows. The first conical surface 108A is configured using an inclined surface (tapered surface) that forms an angle θa with the central axis 101*a*, and the second conical surface 108B is configured using an inclined surface (tapered surface) that forms an angle θb with the central axis 101*a*. The angle θb is larger than the angle θa (angle θb>angle θa), and a valve-side seal portion 108D that contacts the seat portion is formed at a boundary between the first conical surface 108A and the second conical surface 108B.

On the downstream side of the second conical surface 108B, a surface (curved surface) 108E in which an angle θc with the central axis 101*a* becomes larger than the angle θb is formed, and the surface 108E is provided at a position opposing the injection hole inlets 301 to 306.

Reference sign 501 denotes fuel flow on the upstream side of the seat portion 307, and represents the fuel flow at a position where a pressure is higher than that on the downstream side of the seat portion 307. Reference sign 502 denotes fuel flow that flows to the injection hole inlet 301 after passing through the seat portion 307 and flows toward the injection hole outlet 201. Reference sign 503 denotes fuel flow from the center side of the fuel injection valve 101 toward the injection hole inlet 301, and 504 denotes a fuel flow where 502 and 503 merge. Reference signs 505 and 506 denote fuel flow flowing out from the injection hole outlet 201, and the fuel injected from the injection hole outlet 201 becomes fuel spray having spread as indicated by 505 and 506.

The upstream fuel flow 501 is accompanied by a pressure loss in a flow path to the seat portion 307 and the injection hole inlet 301, but flows into the injection hole 301 as indicated by the fuel flow 502 with a small pressure loss after passing through the seat portion 307 since the injection hole inlet 301 is open so as to extend toward the seat portion 307. Further, the fuel flow 504 obtained by mergence between the fuel flow 503 and the fuel flow 501 can flow into the injection hole 301 with a high pressure since the fuel flow 501 is higher pressure than the fuel flow 503 from the center side of the injection hole. With the fuel flow described above, the fuel is guided to the injection hole 301 in a high-pressure state. The fuel spray 505 and 506 injected from the injection hole outlet 201 is reduced in pressure by being affected by an injection field and diffuses to the combustion chamber.

With the fuel flow as described above, it is possible to solve a problem that occurs when fuel is injected into an atmosphere field lower than the atmospheric pressure. That is, the internal pressure of the injection hole can be increased while the fuel spray spreads in the vicinity of the injection hole outlet as a boiling point of fuel becomes low, and thus, it is possible to suppress the spread of the spray in the periphery of the injection hole and to suppress the adhesion of fuel to the outer surface of the injection hole outlet. Thus, it is possible to reduce the amount of deposits deposited in the periphery of the injection hole and to reduce the fuel absorbed by the deposits, and thus, the internal combustion engine can be operated by injecting fuel without generating a starting point of a suspended particulate matter.

Figure 6:
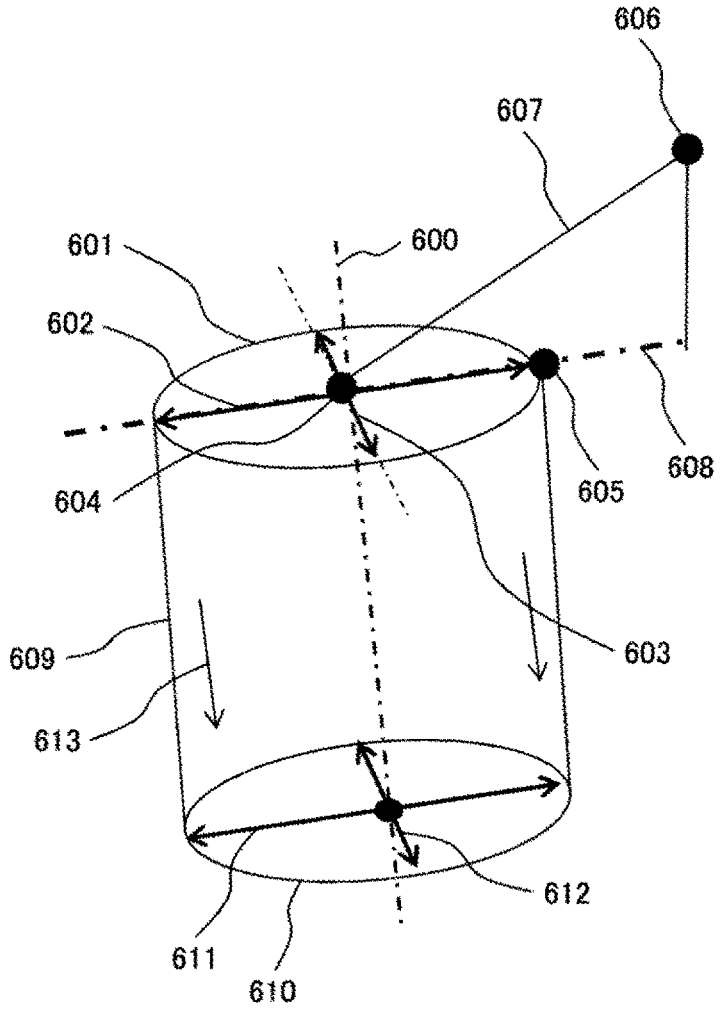
FIG. 6 is a structural view of the injection hole according to the first embodiment.

Subsequently, a specific arrangement of the long axis 401 and the short axis 402 will be described with reference to FIG. 6. FIG. 6 is a structural view of the injection hole according to the first embodiment. Incidentally, the injection hole, the long axis 401 and the short axis 402 that form the injection hole, and the seat portion 307 of the valve 108 are depicted as a conceptual view in FIG. 6.

Reference sign 601 denotes an injection hole surface (cross section) perpendicular to a central axis 600 of the injection hole on the injection hole inlet side, and is formed in a shape having a long axis 602 and a short axis 603. The long axis 602 and the short axis 603 intersect each other at an intersection 604. Reference sign 605 denotes a point (position on a circumference) closest to the seat portion of 601, and 606 denotes a point of the seat portion closest to the injection hole. Reference sign 607 denotes a line connecting 604 and 606, and a line obtained by projecting 607 onto a plane including 601 is 608. Reference sign 610 denotes an injection hole surface (cross section) perpendicular to the central axis 600 of the injection hole on the injection hole outlet side, 611 denotes a long axis of the injection hole surface 610, and 612 denotes a short axis of the injection hole surface 610. The injection hole of the present embodiment is formed such that the area of the cross section 601 of the injection hole on the injection hole inlet side is equal to the area 610 of the cross section of the injection hole on the injection hole outlet side.

When the arrangement regarding the injection hole and the seat portion is described with this configuration, the injection hole surface 601 of at least one injection hole among the plurality of injection holes has the long axis 602 and the short axis 603 intersecting each other. When the line segment 607 from the upstream side to the downstream side of the fuel injection valve 101 is projected with respect to the injection hole surface 601 on a virtual plane including the long axis 602 and the short axis 603, the long axis 602 coincides with the line segment (projected line segment) 608 on the projected virtual plane (injection hole surface 601). Here, "coinciding" means ideally coinciding, and can include deviation caused by a manufacturing error or the like. It is desirable to arrange the injection holes in this manner, and the fuel flow described in FIGS. 4 and 5 can be realized and the pressure in the injection hole can be increased.

Figure 7:
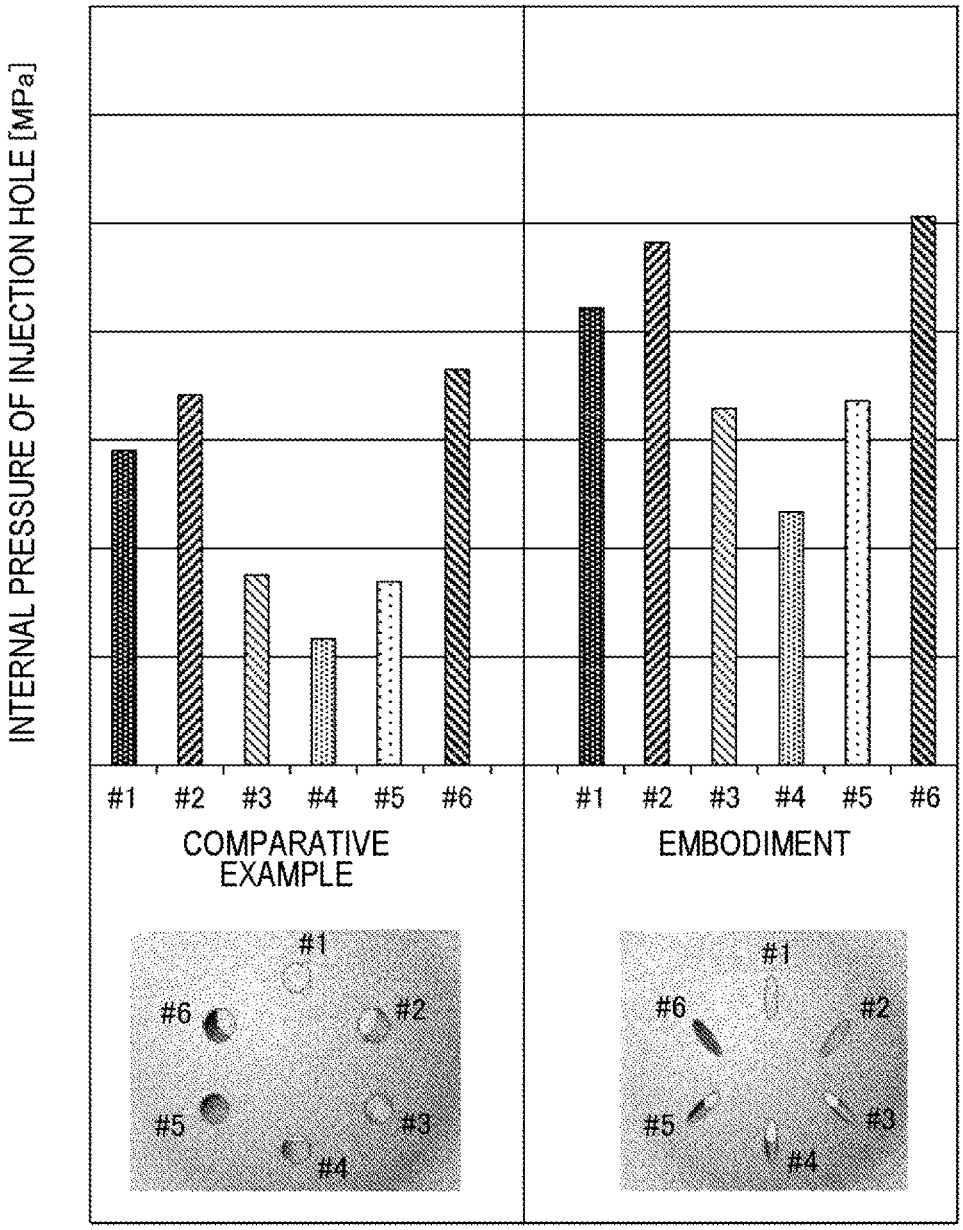
FIG. 7 is a view (bar graph) illustrating a simulation result of an injection hole internal pressure according to the first embodiment.

Next, an example of a result obtained by simulating the pressure in the injection hole when the present embodiment is applied will be described with reference to FIG. 7. FIG. 7 is a view (bar graph) illustrating the simulation result of the injection hole internal pressure according to the first embodiment.

A fuel injection valve having six injection holes is exemplified to illustrate results (embodiment) when the present invention is applied to all of #1 to #6 and results (comparative example) of a comparative example of the present invention. In the comparative example, all the six injection holes have a cross section having a circular shape (perfect circle).

As an evaluation method, steady analysis is used to evaluate a volume average of pressures in the injection holes when a constant pressure is applied from the upstream side of the seat portion. When the present invention is applied, it can be understood that the pressures of all the injection holes #1 to #6 are increased as compared with the comparative example. Since the fuel pressure in the injection hole can be increased in the present embodiment, the pressure at the injection hole outlet is also kept high so that the velocity of the injected fuel increases, and it is possible to suppress the spread of the spray in the vicinity of the injection hole outlet. As a result, the wetting by the fuel on the outer surface of the injection hole outlet can be suppressed, and it is possible to provide the internal combustion engine having favorable exhaust performance.

When the injection hole in FIG. 7 is attached toward the combustion chamber, #1, #2, and #6 are arranged on the spark plug 2703 side so as to be directed toward the spark plug 2703, and #3, #4, and #5 are arranged on the piston 2702 side so as to be directed toward the piston 2702. In particular, according to the results of FIG. 7, the pressures in the injection holes #3, #4, and #5 directed toward the piston 2702 tend to be lower than the pressures in the injection holes #1, #2, and #6 arranged on the spark plug 2703 side due to a large angle in the injection direction.

In order to avoid such a problem, it is desirable that the pressures in the injection holes #3, #4, and #5 be particularly increased. In other words, it is desirable that each long-axis length/short-axis length at the injection hole inlets of the injection holes #3, #4, and #5 directed toward the upper surface of the piston 2702 be larger than each long-axis length/short-axis length at the injection hole inlets of the injection holes #1, #2, and #6 directed toward the distal end of the spark plug 2703 among the plurality of injection holes #1 to #6 in the state of being attached to the internal combustion engine. Meanwhile, there is a concern that an arrival distance of spray may be extended since the velocity at the injection hole outlet increases, but it is possible to shorten the arrival distance of spray by changing the injection direction or by split injection, and thus, the suppression of adhesion of fuel to the combustion chamber by increasing the velocity at the injection hole outlet can be made compatible. Thus, it is possible to suppress generation of soot and the suspended particulate matter based on the adhering fuel by suppressing the wetting of the surface of the injection hole outlet due to the fuel, and to improve the exhaust performance.

Second Embodiment

Figure 8:
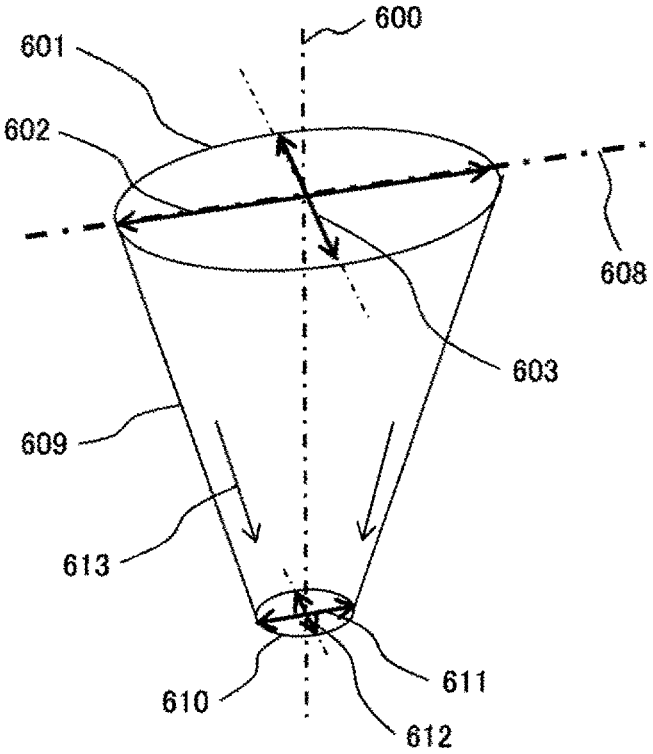
FIG. 8 is a structural view of an injection hole according to a second embodiment.

Next, a second embodiment will be described with reference to FIG. 8. FIG. 8 is a structural view of an injection hole according to the second embodiment. In the present embodiment, the same configurations as those in FIG. 6 will be denoted by the same reference signs as those in FIG. 6, and the description thereof will be omitted.

Reference sign 609 denotes a side wall of the injection hole. The injection hole of the present embodiment is configured such that the area 610 of a cross section of the injection hole on an injection hole outlet side is smaller than the area of the cross section 601 of the injection hole on an injection hole inlet side. In this case, the side wall 609 of the injection hole is preferably configured to be inclined (tapered) with respect to the central axis 600 such that the cross-sectional area of the injection hole decreases gradually from the inlet side toward the outlet side. In this case, the cross-sectional area of the cross section 601 on the injection hole inlet side is preferably increased to expand the long axis 602 toward the seat portion 307, and a diameter of the injection hole (a length of the long axis 611 and a length of the short axis 612) is preferably decreased toward the injection hole outlet.

Next, a relationship between the long axis and the short axis of the injection hole cross section 601 on the inlet side and the injection hole cross section 610 on the outlet side will be described in detail. The long axis on the injection hole outlet side is denoted by 611 and the short axis is denoted by 612. The injection hole is configured such that the length of the long axis 611 of the injection hole cross section 610 is shorter than a length of the long axis 602 of the injection hole cross section 601, and the length of the short axis 612 of the injection hole cross section 610 is shorter than a length of the short axis 603 of the injection hole cross section 601. With this configuration, fuel flow is directed toward the center of the injection hole cross section 610 on the outlet side as proceeding from the injection hole inlet side to the injection hole outlet side as indicated by 613. As a result, the fuel flowing out from the injection hole hardly wets and spreads in the periphery of the injection hole outlet.

In the present embodiment, a ratio of (long axis 602 length/short axis 603 length) in the cross section 601 on the inlet side and (long axis 611 length/short axis 612 length) in the cross section 610 on the outlet side may be different. For example, (long axis 611 length/short axis 612 length) may be smaller than (long axis 602 length/short axis 603 length), or (long axis 611 length/short axis 612 length) may be set to one such that the cross section 610 on the outlet side is formed in a circular shape (perfect circle).

As described above, an effect of adjusting an injection amount and an effect of adjusting a fuel flow direction can be obtained in the present embodiment in addition to the effect of increasing the pressure in the injection hole, which has been described in the first embodiment. Thus, the amount of fuel can be adjusted for each injection direction in accordance with a combustion chamber that differs depending on an internal combustion engine, and thus, it is possible to reduce adhesion of fuel to the combustion chamber and provide the internal combustion engine having favorable exhaust performance.

Third Embodiment

Figure 9:
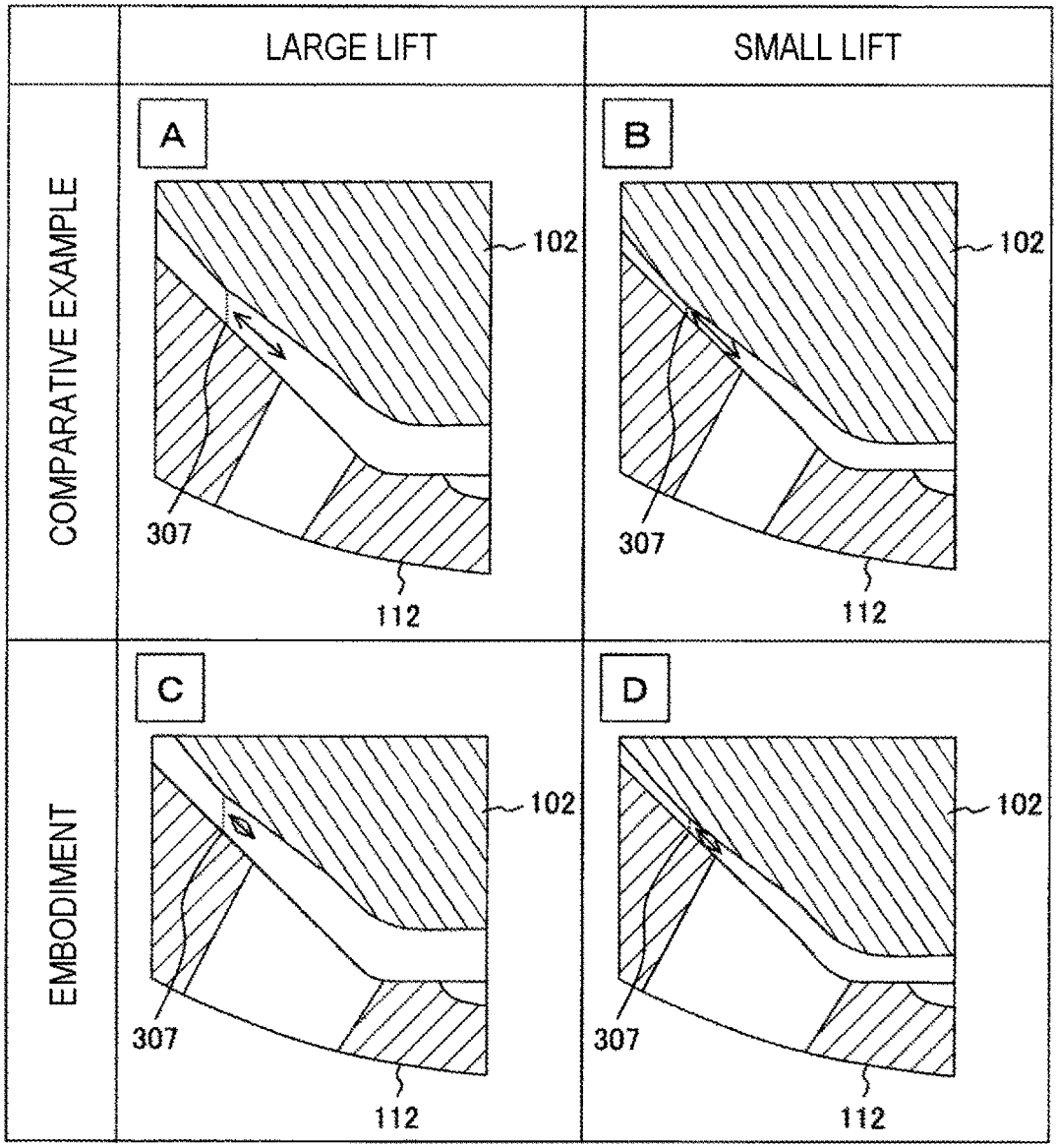
FIG. 9 is a view for describing the influence of a difference in valve lift according to a third embodiment.

Next, a third embodiment will be described with reference to FIG. 9. FIG. 9 is a view for describing the influence of a difference in valve lift according to the third embodiment.

In the present embodiment, lift control of the valve body 102 is performed. FIG. 9 illustrates differences between A and C when the lift amount of the valve body 102 is large and B and D when the lift amount is small regarding Comparative Examples A and B before applying the present invention and Examples C and D to which the present invention is applied.

First, A will be described. In the comparative example, a distance (arrow length) between the seat portion 307 and the injection hole inlet described in FIG. 5 is long, a pressure loss at the seat portion 307 is small since the lift amount of the valve body 102 is large. Thus, the pressure loss is small even if the distance between the seat portion 307 and the injection hole inlet, indicated by the arrow, is long so that fuel can reach the injection hole at a desired pressure, and a pressure in the injection hole can be kept high.

Next, B will be described. In a state where the lift amount of the valve body 102 is small, the cross-sectional area of a flow path in the seat portion 307 decreases, and a pressure loss in the seat portion 307 increases, and thus, a pressure in an injection hole becomes low, and fuel spray spreads in the vicinity of an injection hole outlet. Thus, a risk of occurrence of wetting caused by fuel on an outer surface of the injection hole outlet increases.

In C to which the present invention is applied, a pressure loss in the seat portion 307 is small similarly to the state A, and fuel flows through the injection hole while keeping a high pressure. Thus, a pressure in the injection hole can be kept high.

Next, in D to which the present invention is applied, a pressure loss in the seat portion 307 increases since the lift amount of the valve body 102 is small, and a pressure loss in a fuel passage also increases since a width of the fuel passage on the upstream and downstream sides of the seat portion 307 (an interval between the valve body 102 and the nozzle member 112) is also narrowed. However, fuel can reach the injection hole before receiving a large pressure loss in a downstream fuel flow path of the seat portion 307 since the injection hole inlet expands toward the seat portion such that the long axis of the injection hole extends toward the seat portion. Thus, the present invention can improve the pressure in the injection hole when fuel injection is performed in a state where the lift amount is small, and is suitable for a fuel injection valve that executes fuel injection with different lift amounts.

Fourth Embodiment

Figure 10:
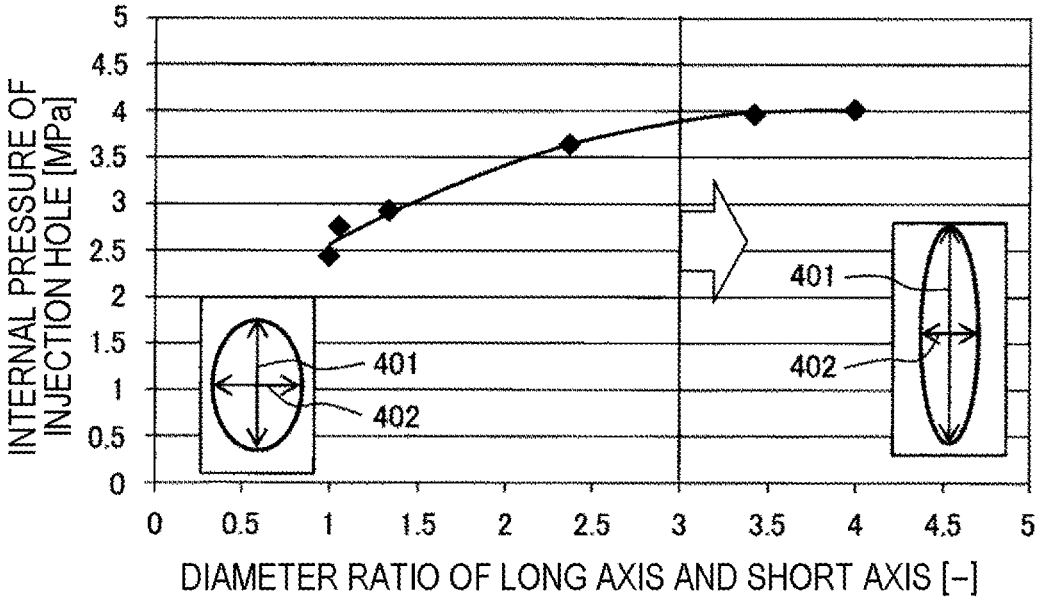
FIG. 10 is an evaluation example of an injection hole internal pressure and a long axis/short axis ratio according to a fourth embodiment.

Next, a fourth embodiment will be described with reference to FIG. 10. FIG. 10 is an evaluation example of an injection hole internal pressure and a long axis/short axis ratio according to a fourth embodiment.

FIG. 10 illustrates a result obtained by evaluating a ratio between the long axis 401 and the short axis 402 at the injection hole inlet. As proceeding to the right, a length of the long axis 401 is longer and the ratio of the long axis 401 to the short axis 402 is larger. When the ratio of the long axis 401 to the short axis 402 is three or more, the pressure in the injection hole becomes substantially constant, and thus, it is desirable to set the ratio of the long axis 401 to the short axis 402 to three or more. If the ratio of the long axis 401 to the short axis 402 can be set to three or more, the pressure of the injection hole can be effectively kept at a high state, and the flow velocity at an injection hole outlet can be increased. As a result, it is possible to suppress spread of spray in the vicinity of the injection hole outlet and to suppress adhesion of fuel to the vicinity of the injection hole outlet. Further, when it is desired to adjust the pressure in the injection hole for each injection hole, a ratio between a long axis and a short axis may be changed for each injection hole for which it is desired to adjust the pressure. As a result, fuel can be injected while reducing a pressure difference between the injection holes, and a state where a pressure of a specific injection hole becomes low can be suppressed.

Fifth Embodiment

Figure 11:
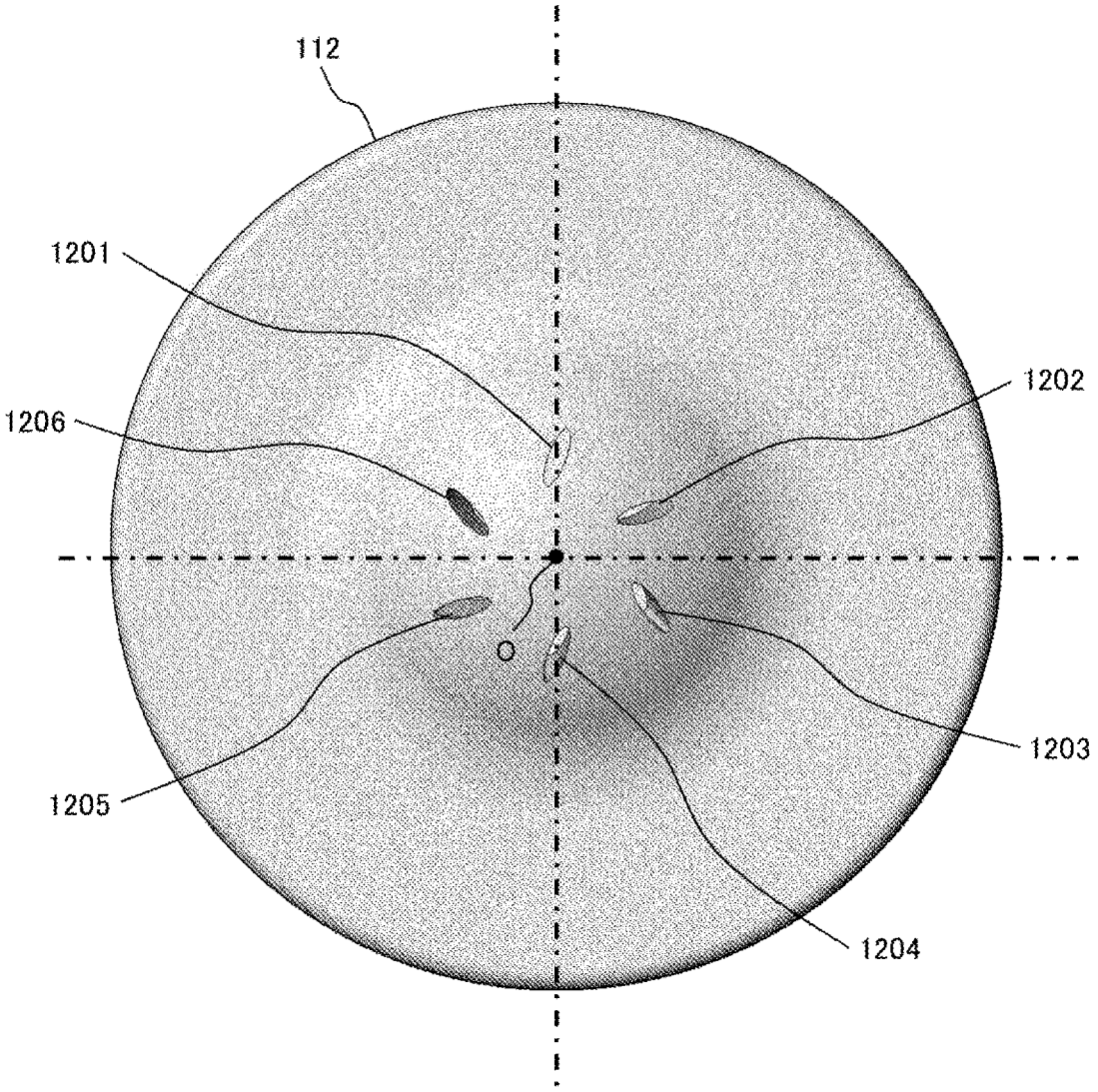
FIG. 11 is a plan view illustrating a configuration of an injection hole outlet according to a fifth embodiment.
Figure 12:
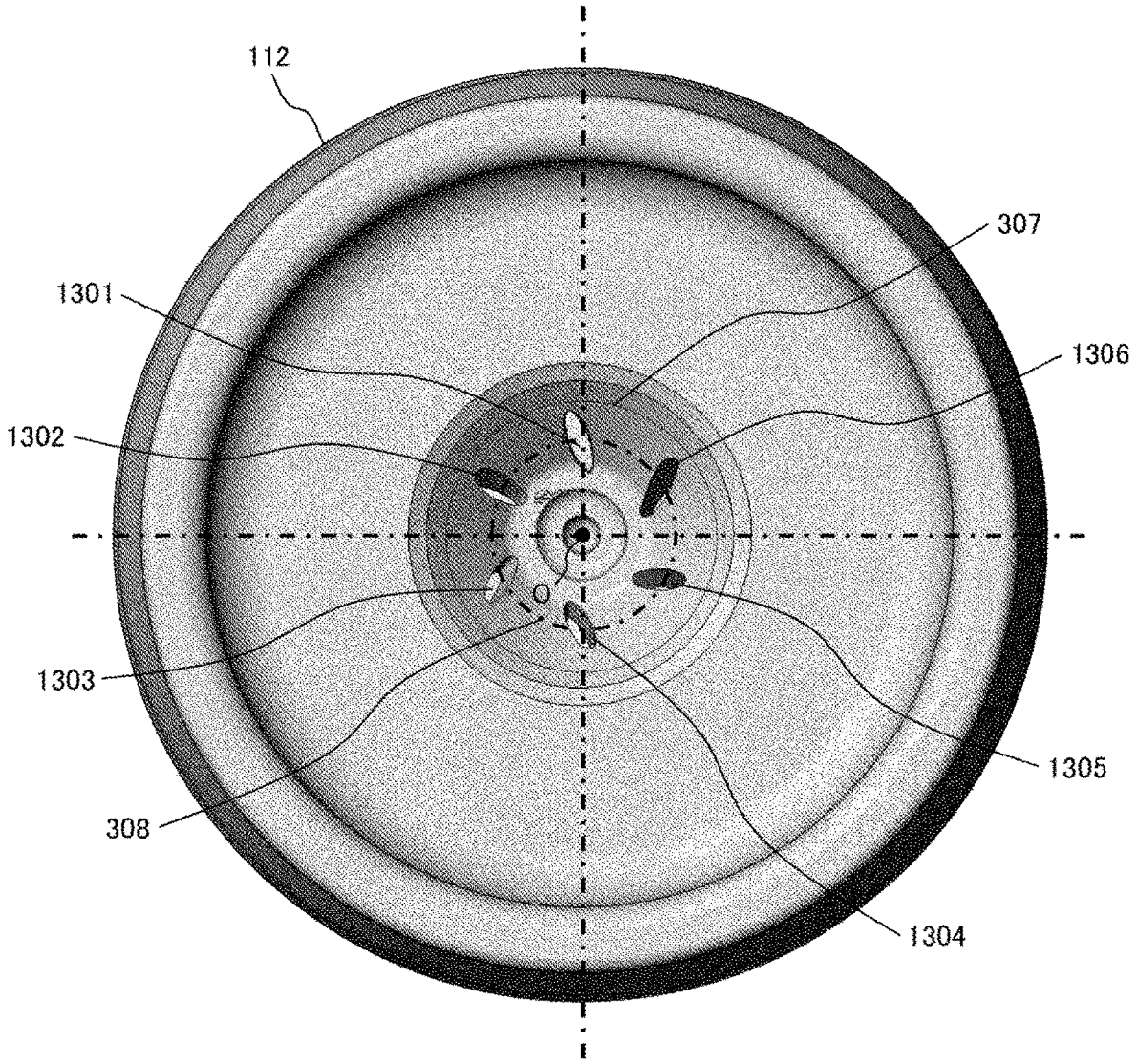
FIG. 12 is a plan view illustrating a configuration of an injection hole inlet according to the fifth embodiment.
Figure 13:
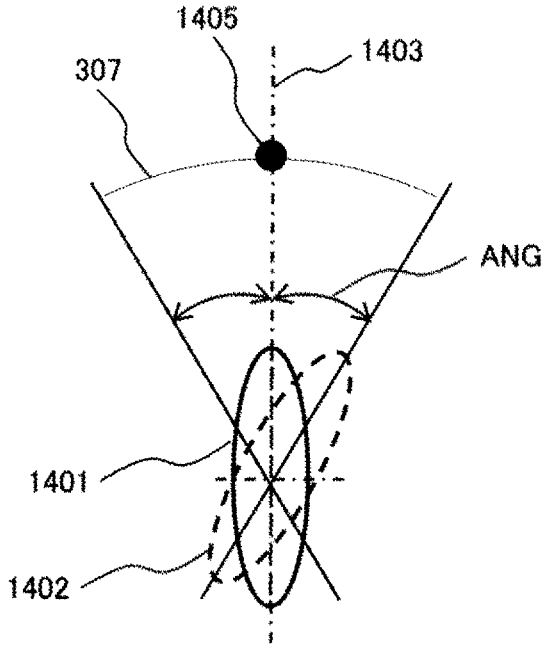
FIG. 13 is a view for describing an effect of an injection hole internal pressure according to the fifth embodiment.
Figure 13:
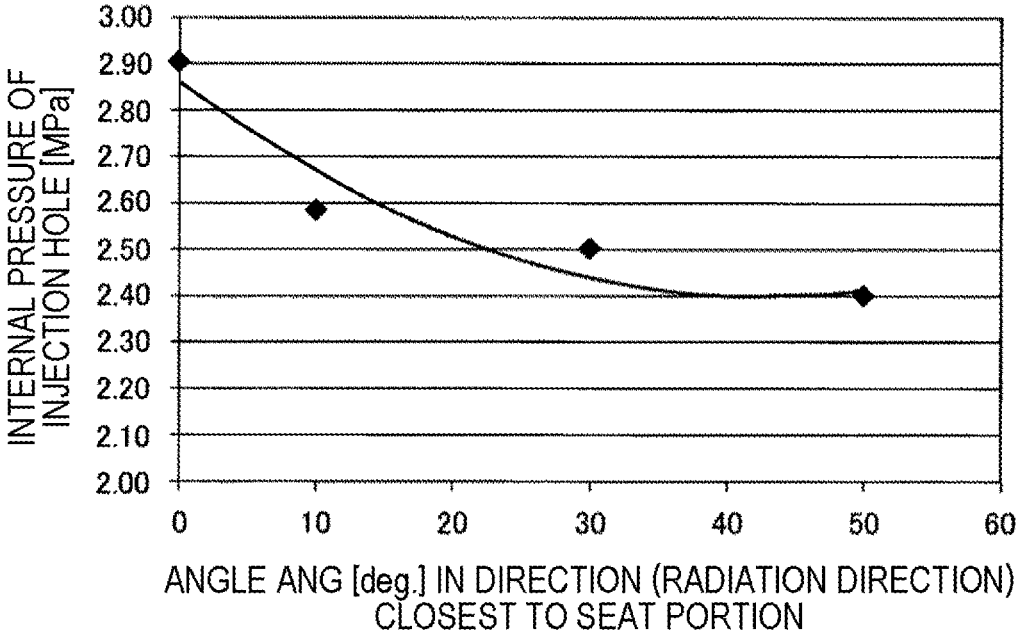

Next, a fifth embodiment will be described with reference to FIGS. 11 and 13. FIG. 11 is a plan view illustrating a configuration of an injection hole outlet according to the fifth embodiment. FIG. 12 is a plan view illustrating a configuration of an injection hole inlet according to the fifth embodiment. FIG. 13 is a view for describing an effect of an injection hole internal pressure according to the fifth embodiment.

FIG. 11 is a view of the nozzle member 112 as seen from the direction 1 in FIG. 1, which is similar to FIG. 2. Even in the present embodiment, the nozzle member 112 includes six injection hole outlets 1201 to 1206, which is similar to FIG. 2.

In the present embodiment, each of the injection hole outlets 1201 to 1206 is inclined at a certain angle with respect to the radiation direction (radial direction) as compared with the first embodiment of FIG. 2. In each of the injection hole outlets 1201 to 1206, a long axis of an injection hole extends toward a seat at the constant angle with respect to the radiation direction.

A state of the injection hole inlet will be described with reference to FIG. 12. Injection hole inlets 1301, 1302, 1303, 1304, 1305, and 1306 illustrated in FIG. 12 correspond to the injection hole outlets 1201, 1202, 1203, 1204, 1205, and 1206 of FIG. 11, respectively.

In the following description, the injection holes are designated using reference signs 1301, 1302, 1303, 1304, 1305, and 1306 of the injection hole inlets. For example, an injection hole having the injection hole inlet 1301 and the injection hole outlet 1201 will be described as the injection hole 1301.

The injection hole inlets 1301 to 1306 are inclined at a certain angle with respect to the radiation direction (radial direction) similarly to the injection hole outlets 1201 to 1206. The injection hole inlets 1301 to 1306 expand toward the seat portion 307 such that the long axis of the injection hole extends toward the seat at the certain angle with respect to the radiation direction in each of the injection hole inlets 1301 to 1306. Specific angles of the injection hole inlets 1301 to 1306 will be described with reference to the view of FIG. 13 illustrating a relationship between the angle of the injection hole inlet and the injection hole internal pressure.

Similarly to FIG. 3 of the first embodiment, it is optimum for centroids of the plurality of injection holes 1301 to 1306 that centroids of all the injection holes are arranged on the same circle of 308, and it is desirable that centroids of at least two or more injection holes be arranged on the same circle of 308.

Subsequently, a case where the injection hole inlets 1301 to 1306 have an angle from a direction closest to the seat portion 307 (the radiation direction or a radius direction) will be described with reference to FIG. 13. Incidentally, the following description on the angle is given based on the plan view of FIG. 13 (a virtual plane perpendicular to the central axis 101*a*).

Reference sign 1401 denotes each of the injection hole inlets 1301 to 1306 in a state where a long axis is directed in the direction closest to the seat portion 307, and 1402 denotes each of the injection hole inlets 1301 to 1306 having a certain angle with respect to the direction closest to the seat portion 307. Reference sign 1403 denotes a line segment indicating the direction in which each of the injection hole inlets 1301 to 1306 is closest to the seat portion 307, and the long axis of the injection hole inlet 1401 coincides with the line segment 1403. Reference sign 1405 denotes a point (position) where the seat portion 307 is closest to the injection hole inlet 1401, and ANG denotes an inclination angle of the injection hole inlet 1402 from the line segment (proximity direction) 1403.

The graph illustrated in FIG. 13 is a result of analysis performed by the author and the like, and illustrates a relationship between a representative value of the pressure in the injection hole and the inclination angle ANG. According to this relationship, it can be understood that the pressure in the injection holes 1301 to 1306 can be increased when the inclination angle ANG is set to 50 deg. or smaller. Thus, it is desirable that the long axes 602 and 611 described in FIG. 6 or FIG. 8 have the inclination angle ANG of 50° or smaller with respect to the line segment 608.

In the present embodiment, not only it is possible to increase the pressure in the injection hole similarly to the first embodiment, but also it is possible to increase a pressure on a wall surface of the injection hole by a centrifugal force acting on fuel since the fuel can be made to flow into the injection holes 1301 to 1306 while swirling by setting the inclination angle ANG of the injection hole inlets 1301 to 1306 to the angle larger than 0°. Thus, it is possible to suppress wetting caused by the fuel on an outer surface of the injection hole outlet and to suppress generation of soot and a suspended particulate matter due to the wetting caused by the fuel. As a result, the present embodiment can provide an internal combustion engine having favorable exhaust performance.

Sixth Embodiment

Figure 14:
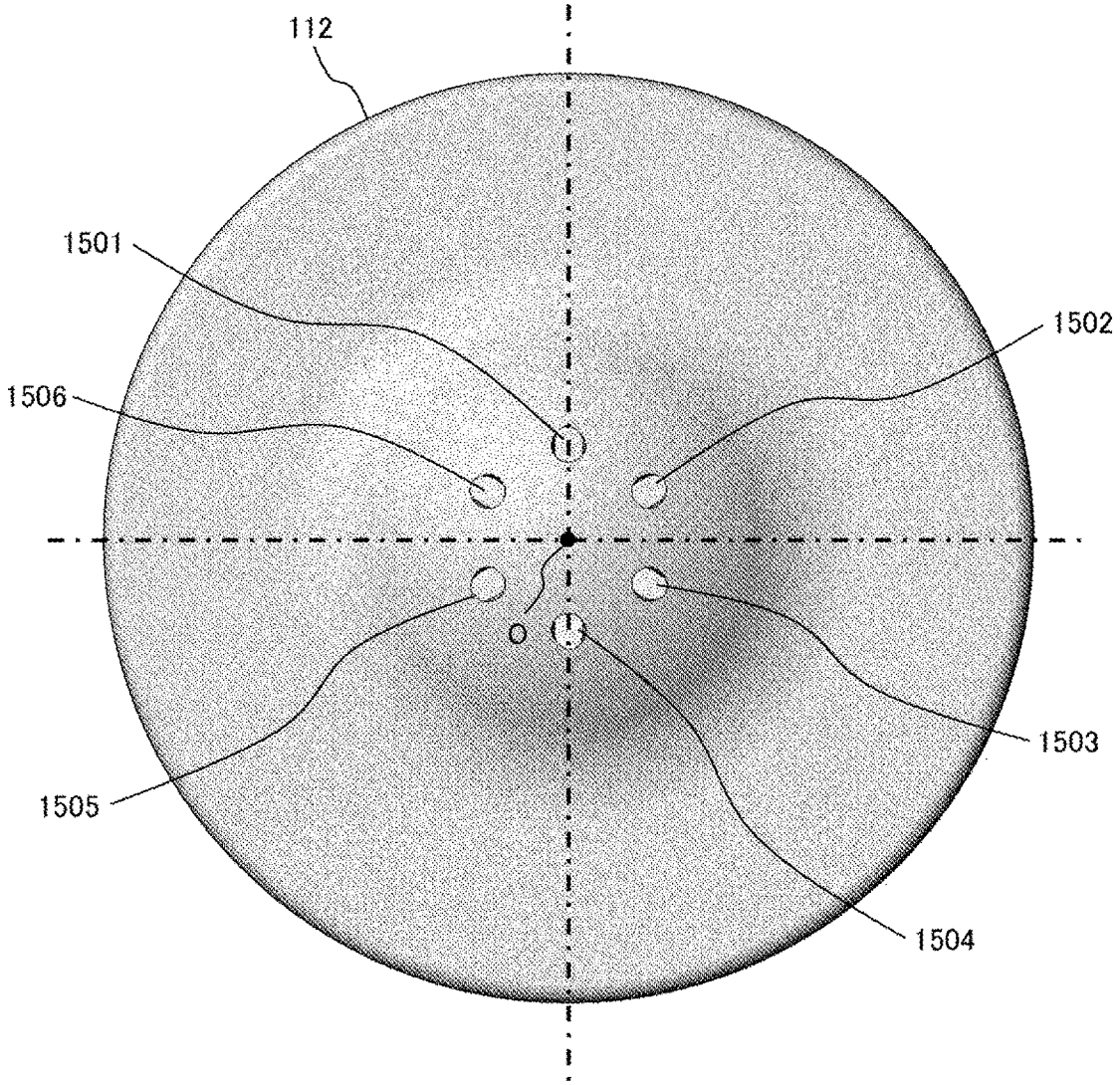
FIG. 14 is a plan view illustrating a configuration of an injection hole outlet according to a sixth embodiment.
Figure 15:
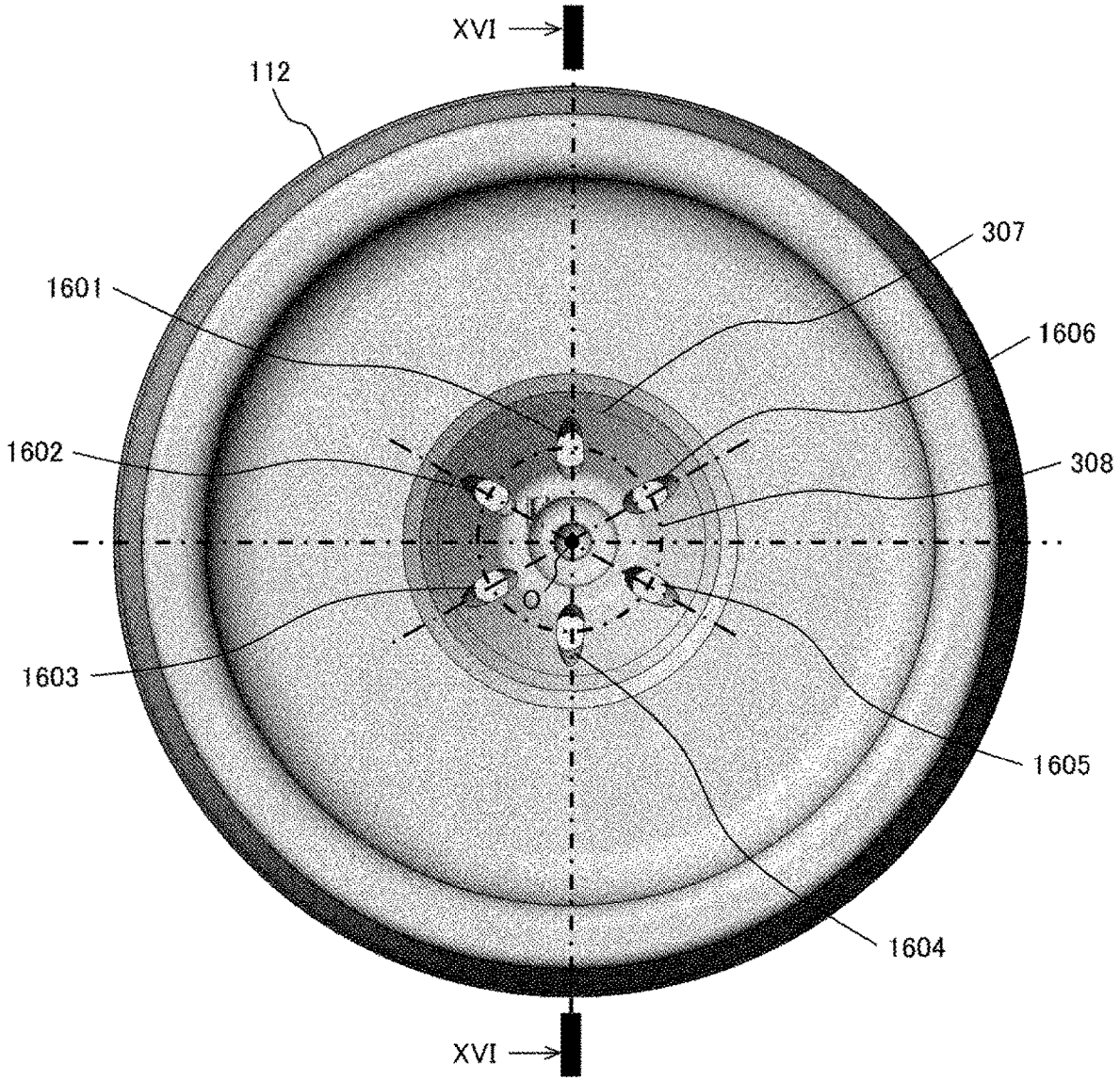
FIG. 15 is a plan view illustrating a configuration of an injection hole inlet according to the sixth embodiment.
Figure 16:
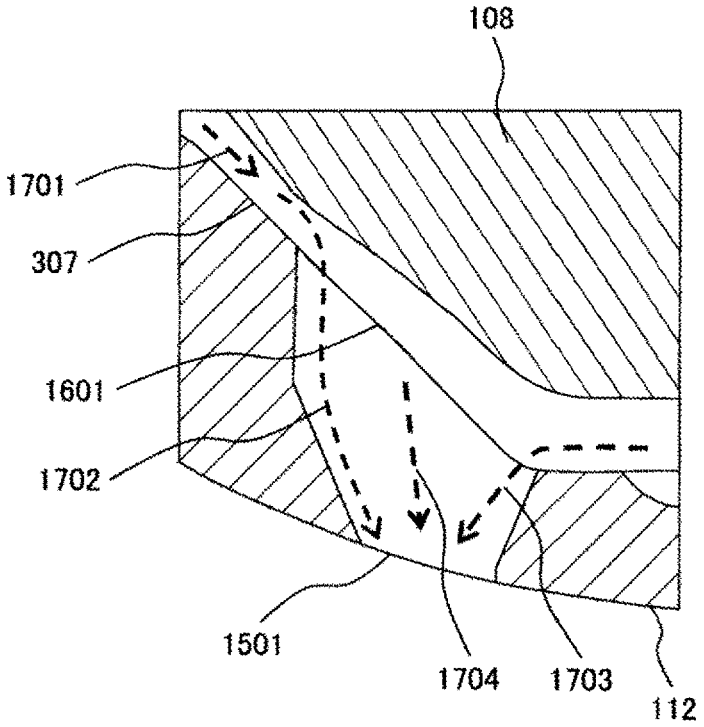
FIG. 16 is a cross-sectional view of an injection hole according to the sixth embodiment.

Next, a sixth embodiment will be described with reference to FIGS. 14 to 16. FIG. 14 is a plan view illustrating a configuration of an injection hole outlet according to the sixth embodiment. FIG. 15 is a plan view illustrating a configuration of an injection hole inlet according to the sixth embodiment. FIG. 16 is a cross-sectional view of an injection hole according to the sixth embodiment.

FIG. 14 is the view as seen from the direction 1 in FIG. 1, which is similar to FIG. 2. Even in the present embodiment, the nozzle member 112 includes six injection hole outlets 1501 to 1506, which is similar to FIG. 2. In the present embodiment, the injection hole outlets 1501 to 1506 each having a circular shape with a small ratio between a long axis and a short axis are provided as a characteristic configuration.

On the other hand, injection hole inlets 1601 to 1606 are configured in a shape having a long axis and a short axis as illustrated in FIG. 15, a direction of the long axis extends toward the seat portion 307, and the injection hole inlets

1601 to 1606 expand toward the seat portion 307. The shapes of the injection hole inlets 1601 to 1606 can be the same shapes as those in the respective embodiments described above.

In the following description, the injection holes are designated using reference signs 1601, 1602, 1603, 1604, 1605, and 1606 of the injection hole inlets. For example, an injection hole having the injection hole inlet 1601 and the injection hole outlet 1501 will be described as the injection hole 1601.

In the present embodiment, the long axis coincides with the radiation direction in all the injection hole inlets 1601 to 1606. Directions of the long axes of the respective injection holes may be configured such that long axes of some injection hole inlets coincide with the radiation direction, or may be configured similarly to the directions in the respective embodiments described above.

Next, a description will be given with reference to FIG. 16. FIG. 16 is an enlarged view of the vicinity of the injection hole 1601 in a XVI-XVI cross section. Reference sign 1701 denotes fuel flow on the upstream side of the seat portion 307.

A fuel flow path on the upstream side of the seat portion 307 has a higher pressure than a fuel flow path on the downstream side of the seat portion. The fuel flow 1701 flows to the injection hole inlet 1601 after passing through the seat portion 307, and becomes fuel flow 1702 flowing toward the injection hole outlet 1501. Reference sign 1703 denotes flow from the center side of the fuel injection valve 101 (nozzle member 112) toward the injection hole inlet 1601, and 1704 denotes flow in which 1701 (or 1702) and 1703 merge.

The flow 1701 is accompanied by a pressure loss at the seat portion 307 and a pressure loss at the flow path toward the injection hole inlet 1601, but can flow into the injection hole 1601 as indicated by 1702 with a small pressure loss after passing through the seat portion 307 since the injection hole inlet 1601 is configured to expand toward the seat portion 307.

Further, the pressure of the fuel flow 1703 decreases, but merges with the fuel flow 1701 kept at a high pressure so that it is possible to keep the pressure in the injection hole at a high pressure.

Further, the injection hole outlets 1501 to 1506 have a shape closer to a circular shape since the ratio of the long axis to the short axis in the injection hole outlets 1501 to 1506 of the injection holes 1601 to 1606 is smaller than that in the injection holes 301 to 306 of FIG. 5 according to the first embodiment, and thus, the fuel flow 1702 and 1703 is injected from the injection hole outlets 1501 to 1506 in a direction so as not to spread in the radial direction. In the present embodiment, the ratio of the long axis/short axis in the injection hole outlets 201 to 206 illustrated in the first embodiment is minimized (=1) to form the injection hole outlets 201 to 206 in the circular shape (perfect circle). It is unnecessary to minimize the ratio of the long axis/short axis (=1), and it is sufficient to set the ratio of the long axis/short axis in the injection hole outlets 1501 to 1506 to be smaller than the ratio of the long axis/short axis in the injection hole inlets 1601 to 1606 although the above effect is reduced.

In the present embodiment, it is possible to suppress wetting caused by fuel on an outer surface of the injection hole outlet since the fuel flow is directed toward the inner side (center side) of the injection hole similarly to the effect described in the second embodiment of FIG. 8, and further, it is possible to adjust a flow rate for each injection hole by changing the ratio of the long axis/short axis among the plurality of injection holes and to adjust the amount of fuel to be injected in accordance with a shape of a combustion chamber.

Seventh Embodiment

Figure 17:
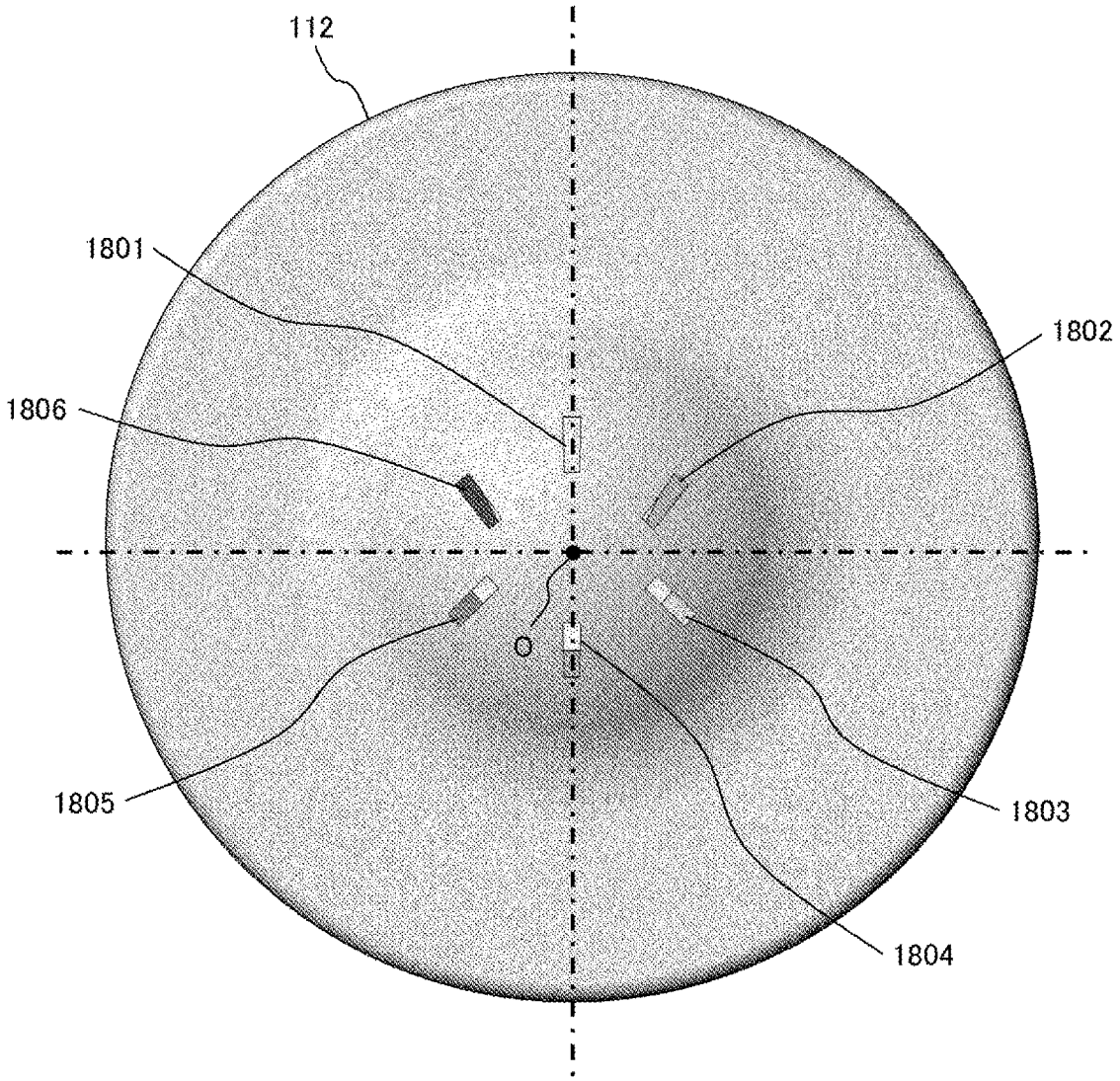
FIG. 17 is a plan view illustrating a configuration of an injection hole outlet according to a seventh embodiment.
Figure 18:
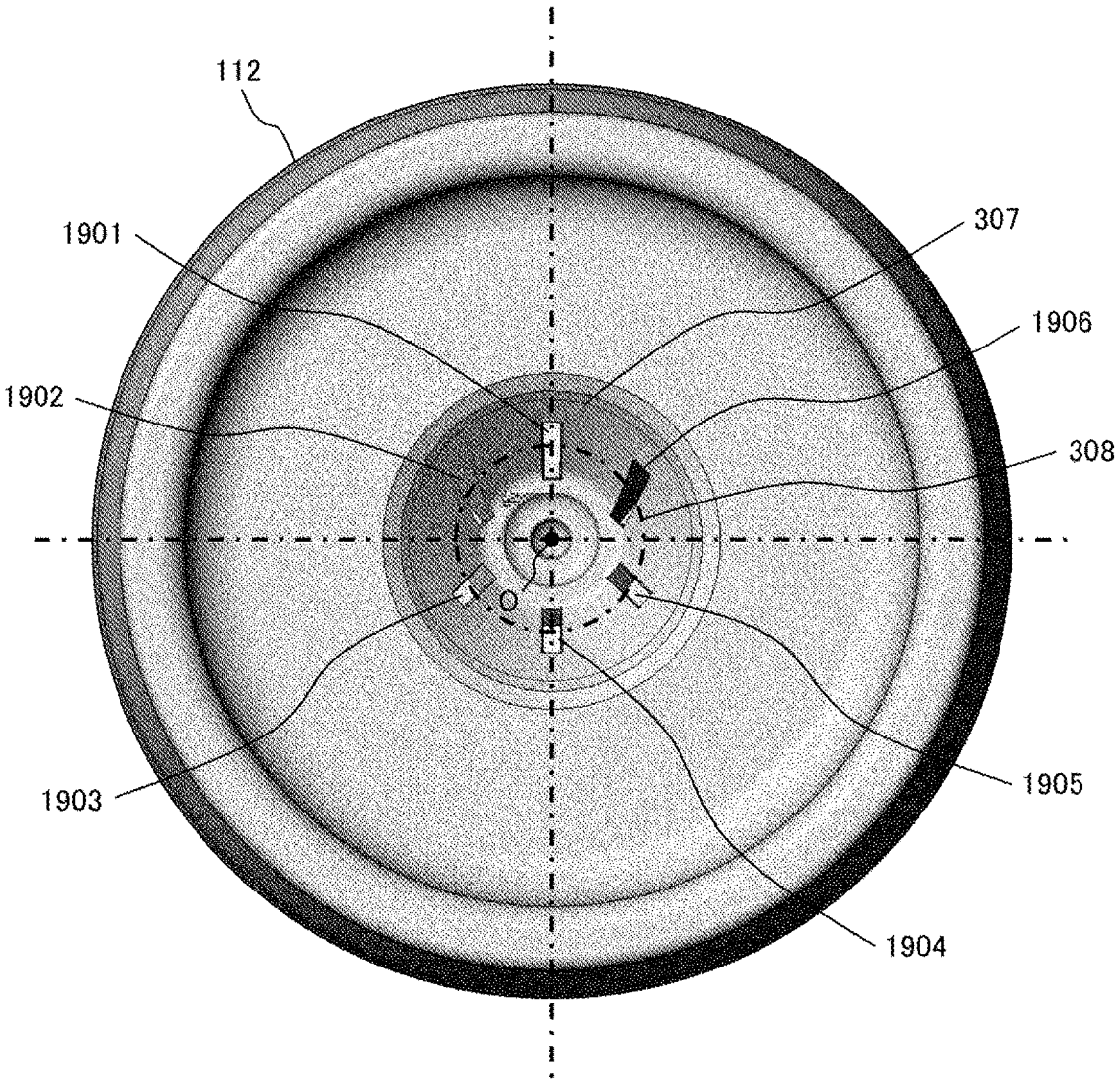
FIG. 18 is a plan view illustrating a configuration of an injection hole inlet according to the seventh embodiment.

Next, a seventh embodiment will be described with reference to FIGS. 17 and 18. FIG. 17 is a plan view illustrating a configuration of an injection hole outlet according to the seventh embodiment. FIG. 18 is a plan view illustrating a configuration of an injection hole inlet according to the seventh embodiment.

FIG. 17 illustrates injection hole outlets 1801 to 1806 of the fuel injection valve 101, which is similar to FIG. 2. FIG. 18 illustrates injection hole inlets 1901 to 1906, which is similar to FIG. 3. In the following description, the injection holes are designated using reference signs 1901, 1902, 1903, 1904, 1905, and 1906 of the injection hole inlets. For example, an injection hole having the injection hole inlet 1901 and the injection hole outlet 1801 will be described as the injection hole 1901.

In the present embodiment, the injection hole outlets 1801 to 1806 and the injection hole inlets 1901 to 1906 have a rectangular shape, and an injection hole portion between each of the injection hole inlets 1901 to 1906 and each of the injection hole outlets 1801 to 1806 also has a rectangular cross section as characteristic configurations.

As illustrated in FIGS. 17 and 18, the injection hole inlets 1901 to 1906 and the injection hole outlets 1801 to 1806 are configured in the rectangular shape having a long axis and a short axis, a direction of the long axis extends toward the seat portion 307, and each cross section of the injection holes 1901 to 1906 expands toward the seat portion 307. The configurations and arrangements of long axes and short axes of the injection holes 1901 to 1906 are the same as those in the first embodiment.

Although the injection hole inlets 1901 to 1906 to the injection hole outlets 1801 to 1806 have the same shape in the present embodiment, the injection hole outlets 1801 to 1806 are not necessarily rectangular. Further, the injection holes 1901 to 1906 may be configured such that the area of each cross section of the injection hole outlets 1801 to 1806 is smaller than the area of each cross section of the injection hole inlets 1901 to 1906.

Since the injection hole expands toward the seat portion even in the shape of the present embodiment, the same effect as that in the first embodiment can be obtained. Then, the opening area in the seat direction can be ensured to be wide, a pressure loss until fuel reaching the injection hole can be reduced, and a pressure in the injection hole can be increased. As a result, it is possible to inject the fuel from the injection hole while keeping a high pressure, and thus, it is possible to increase the flow velocity at the injection hole outlet and to suppress spread of spray in the vicinity of the injection hole. Then, it is possible to reduce wetting caused by the injected fuel on an outer surface of the injection hole outlet.

Eighth Embodiment

Figure 19:
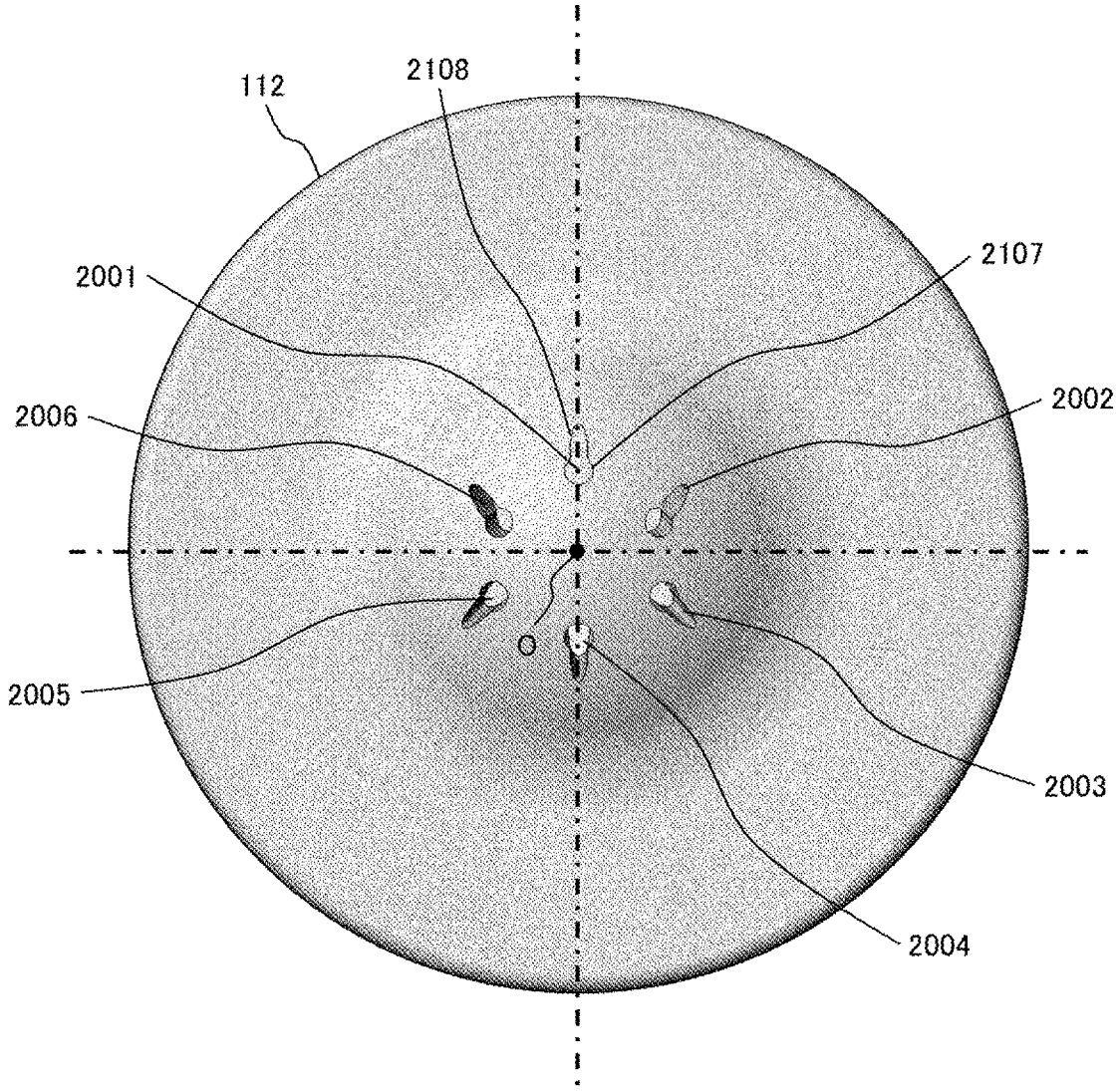
FIG. 19 is a plan view illustrating a configuration of an injection hole outlet according to an eighth embodiment.
Figure 20:
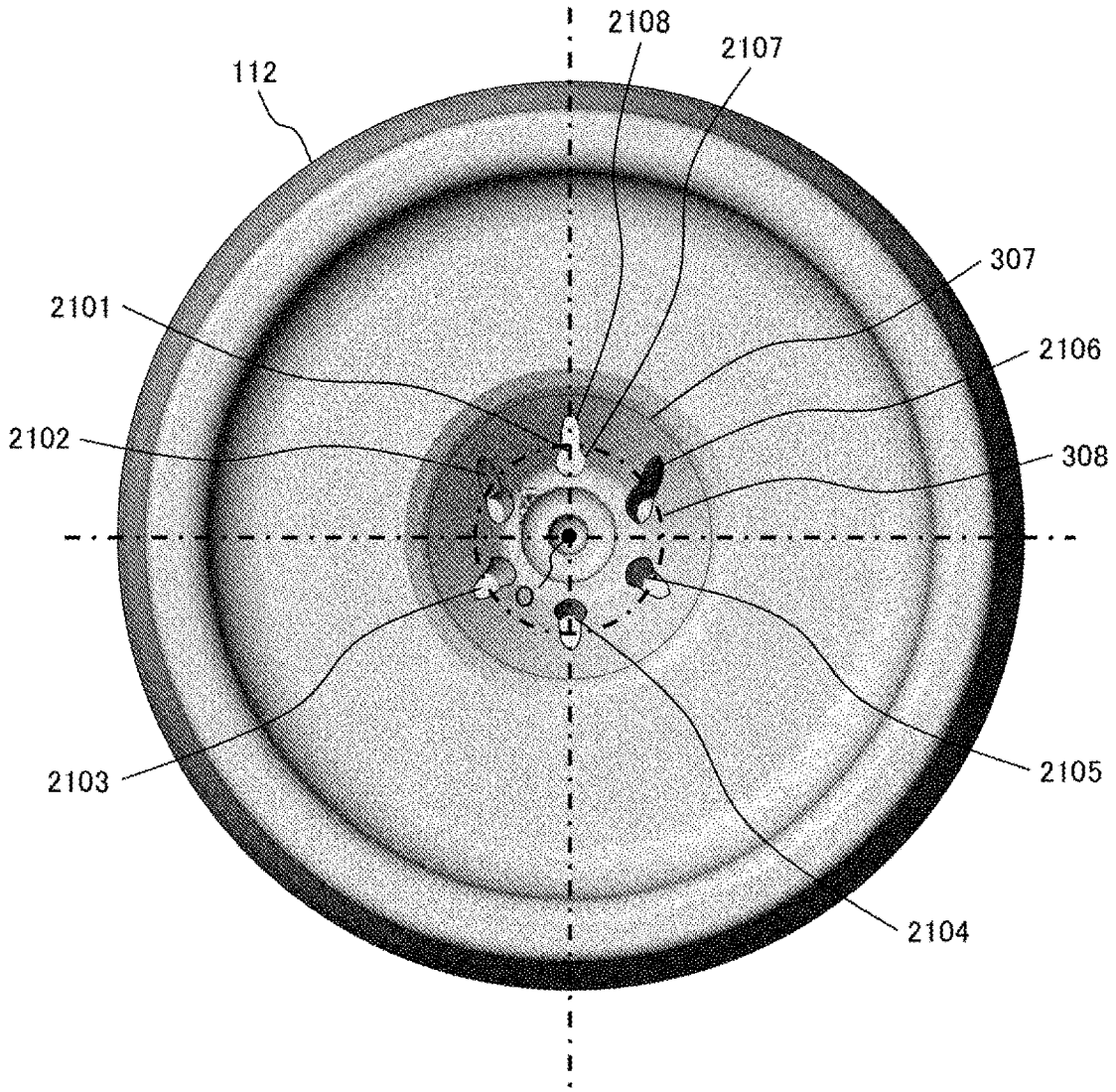
FIG. 20 is a plan view illustrating a configuration of an injection hole inlet according to the eighth embodiment.

Next, an eighth embodiment will be described with reference to FIGS. 19 and 20. FIG. 19 is a plan view illustrating a configuration of an injection hole outlet according to the eighth embodiment. FIG. 20 is a plan view illustrating a configuration of an injection hole inlet according to the eighth embodiment.

Figure 21:
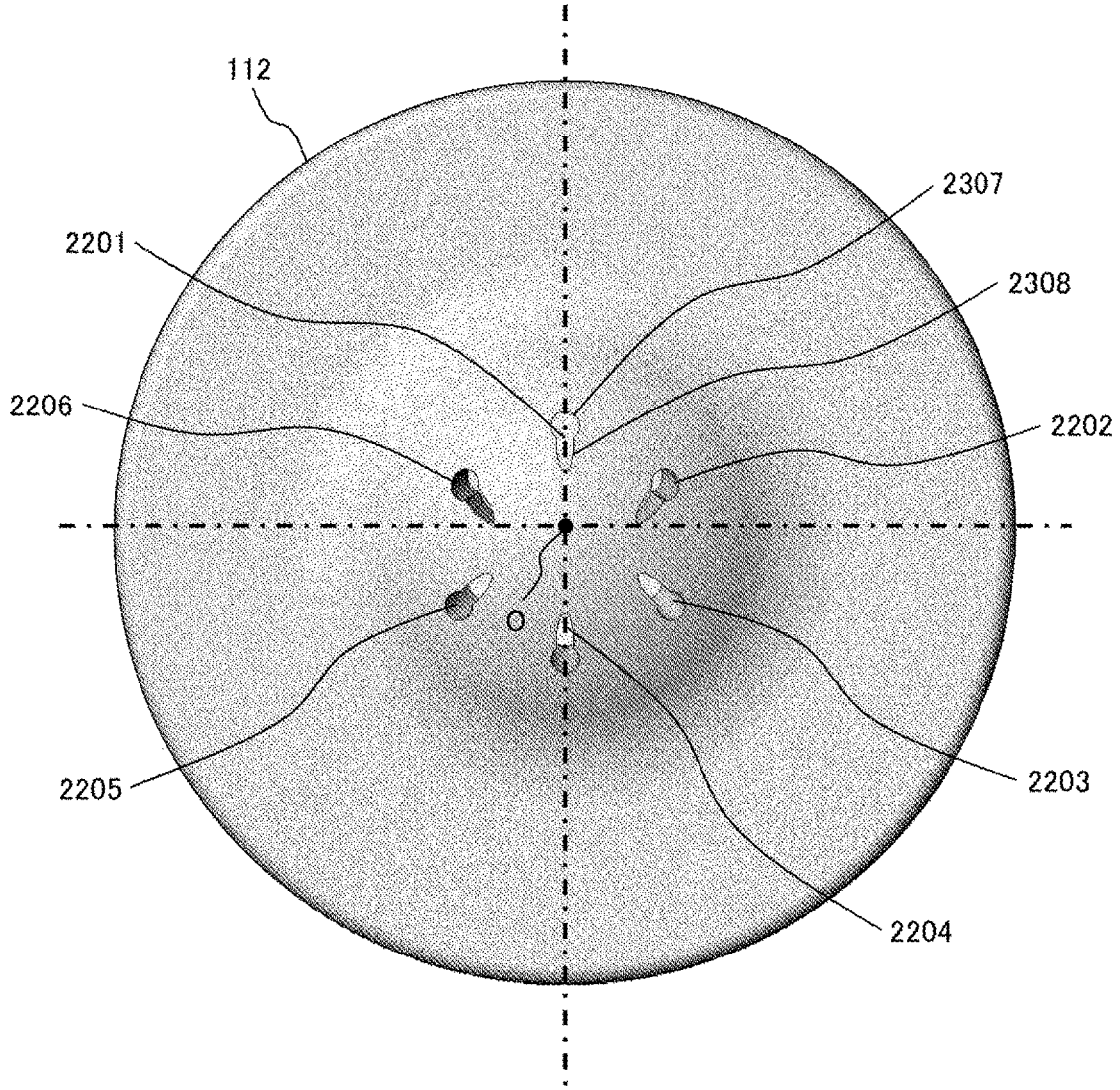
FIG. 21 is a plan view illustrating a configuration of an injection hole outlet according to a ninth embodiment.

FIG. 19 illustrates injection hole outlets 2001 to 2006 of the fuel injection valve 101, which is similar to FIG. 2. FIG. 21 illustrates injection hole inlets 2101 to 2106, which is similar to FIG. 3. In the following description, the injection holes are designated using reference signs 2101, 2102, 2103, 2104, 2105, and 2106 of the injection hole inlets. For example, an injection hole having the injection hole inlet 2101 and the injection hole outlet 2001 will be described as the injection hole 2101.

In the present embodiment, the injection hole outlets 2001 to 2006 and the injection hole inlets 2101 to 2106 have a shape that has a circular hole 2107 and a long hole (for example, an ellipse) 2108, and an injection hole portion between each of the injection hole inlets 2101 to 2106 and each of the injection hole outlets 2001 to 2006 also has a cross-sectional shape that has the circular hole 2107 and the elongated hole 2108 as characteristic configurations. As a result, the injection holes 2101 to 2106 expand from the circular hole 2107 toward the seat portion 307, and an injection hole diameter is smaller on the side close to the seat portion 307 (an opening width of the injection hole is narrower). That is, the injection hole inlets 2101 to 2106 and the injection hole outlets 2001 to 2006 are formed in a shape having a long axis and a short axis.

Although the injection hole inlets 2101 to 2106 to the injection hole outlets 2001 to 2006 have the same shape in the present embodiment, the injection hole outlets 2001 to 2006 do not necessarily have the same shape as the injection hole inlets 2101 to 2106. Further, although all the injection holes 2101 to 2106 have the same shape, the characteristic configurations of the present embodiment may be adopted by being limited to a specific injection hole for which it is desired to adjust a pressure.

Even in the shape of the present embodiment, since the injection holes 2101 to 2106 expand in the direction of the seat portion 307 as in the first embodiment, the pressure in the injection holes can be increased. Furthermore, the injection hole diameter becomes smaller on the side close to the seat portion 307 in the present embodiment so that a pressure throttle can be provided for each injection hole. Thus, the pressure can be adjusted for each of the plurality of injection holes. Then, it is possible to improve the nonuniformity of the pressure for every injection hole.

Ninth Embodiment

Figure 22:
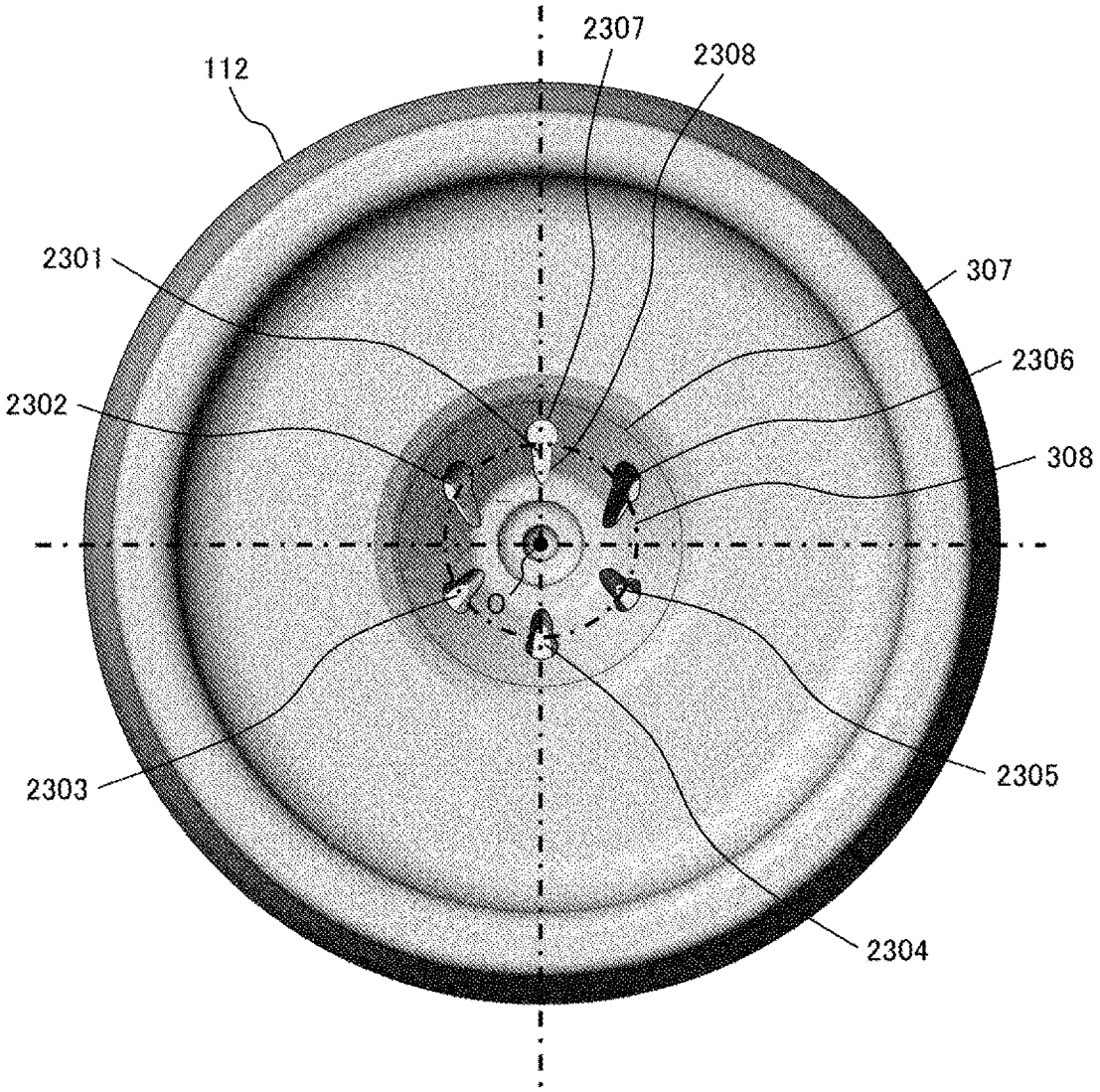
FIG. 22 is a plan view illustrating a configuration of an injection hole inlet according to the ninth embodiment.

Next, a ninth embodiment will be described with reference to FIGS. 21 and 22. FIG. 21 is a plan view illustrating a configuration of an injection hole outlet according to the ninth embodiment. FIG. 22 is a plan view illustrating a configuration of an injection hole inlet according to the ninth embodiment.

FIG. 21 illustrates injection hole outlets 2201 to 2206 of the fuel injection valve 101, which is similar to FIG. 2. FIG. 22 illustrates injection hole inlets 2301 to 2306, which is similar to FIG. 3. In the following description, the injection holes are designated using reference signs 2301, 2302, 2303, 2304, 2305, and 2306 of the injection hole inlets. For example, an injection hole having the injection hole inlet 2301 and the injection hole outlet 2201 will be described as the injection hole 2301.

In the present embodiment, the injection hole outlets 2201 to 2206 and the injection hole inlets 2301 to 2306 have a shape that has a circular hole 2307 and a long hole (for example, an ellipse) 2308, and an injection hole portion between each of the injection hole inlets 2301 to 2306 and each of the injection hole outlets 2201 to 2206 also has a cross-sectional shape that has the circular hole 2307 and the elongated hole 2308 as characteristic configurations. In the present embodiment, the circular hole 2307 is arranged on the side close to the seat portion 307, and the elongated hole 2308 is arranged on the side close to the center O of the nozzle member 112. As a result, the injection holes 2301 to 2306 expand toward the seat portion 307, and an injection hole diameter increases toward the seat portion 307. That is, the injection hole inlets 2301 to 2306 and the injection hole outlets 2201 to 2206 are formed in a shape having a long axis and a short axis.

Although the injection hole inlets 2301 to 2306 to the injection hole outlets 2201 to 2206 have the same shape in the present embodiment, the injection hole outlets 2201 to 2206 do not necessarily have the same shape as the injection hole inlets 2301 to 2306. Further, although all the injection holes 2301 to 2306 have the same shape, the characteristic configurations of the present embodiment may be adopted by being limited to a specific injection hole for which it is desired to increase a pressure.

Even in the shape of the present embodiment, since the injection holes 2301 to 2306 expand toward the seat portion 307 as in the first embodiment, the pressure in the injection holes can be increased. Furthermore, an opening area on the side close to the seat portion 307 is large in the present embodiment, and thus, the pressure in the injection hole can be further increased as compared with the above-described embodiment, and it is possible to increase a flow rate in the injection hole. Further, the flow rate can be adjusted for each injection hole by applying the present embodiment only to a specific injection hole or changing a diameter of the circular hole 2307. The present embodiment may be combined with the eighth embodiment, and the circular holes may be provided at both ends in a long-axis direction of the long hole.

Tenth Embodiment

Figure 23:
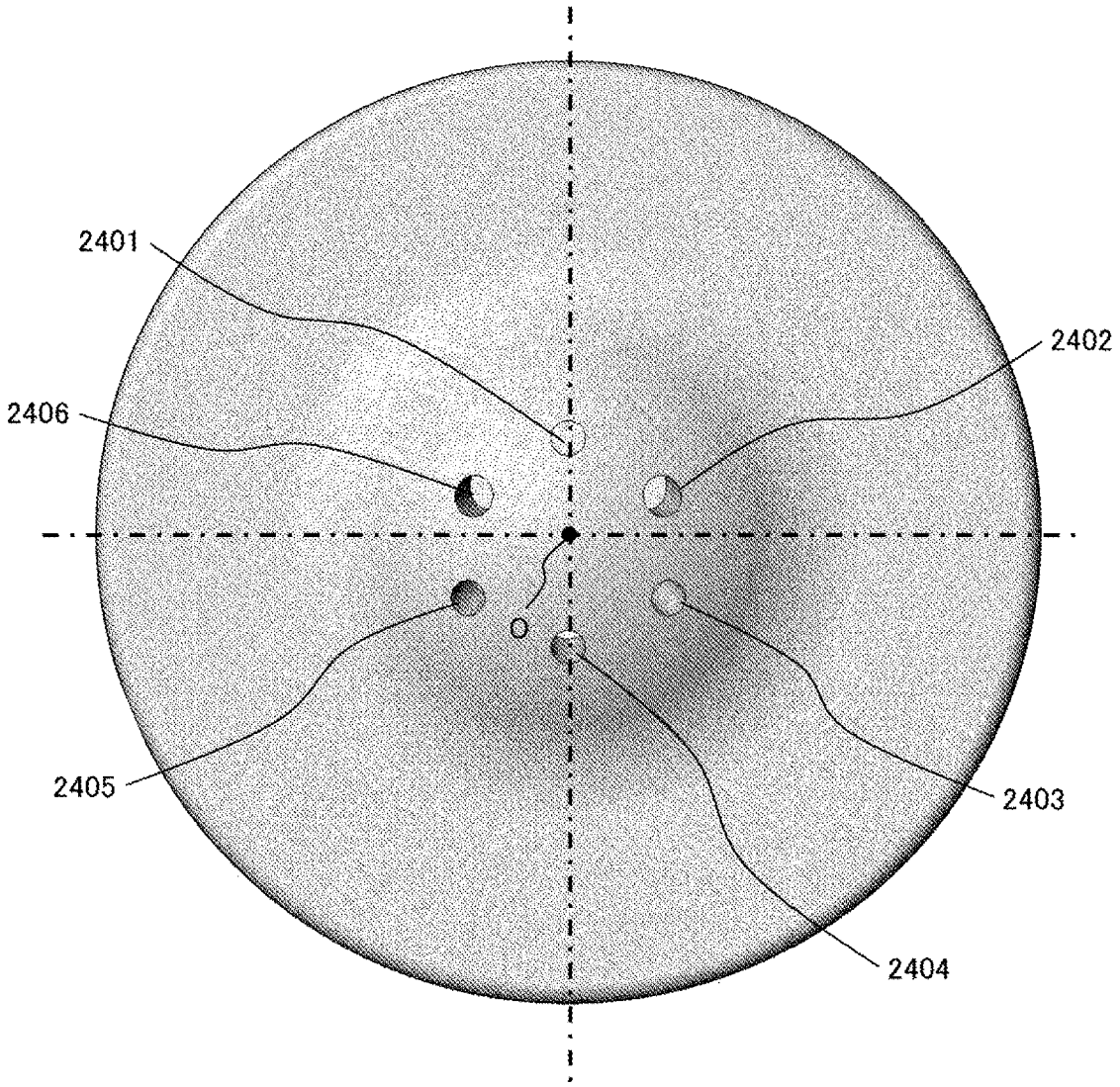
FIG. 23 is a plan view illustrating a configuration of an injection hole outlet according to a tenth embodiment.
Figure 24:
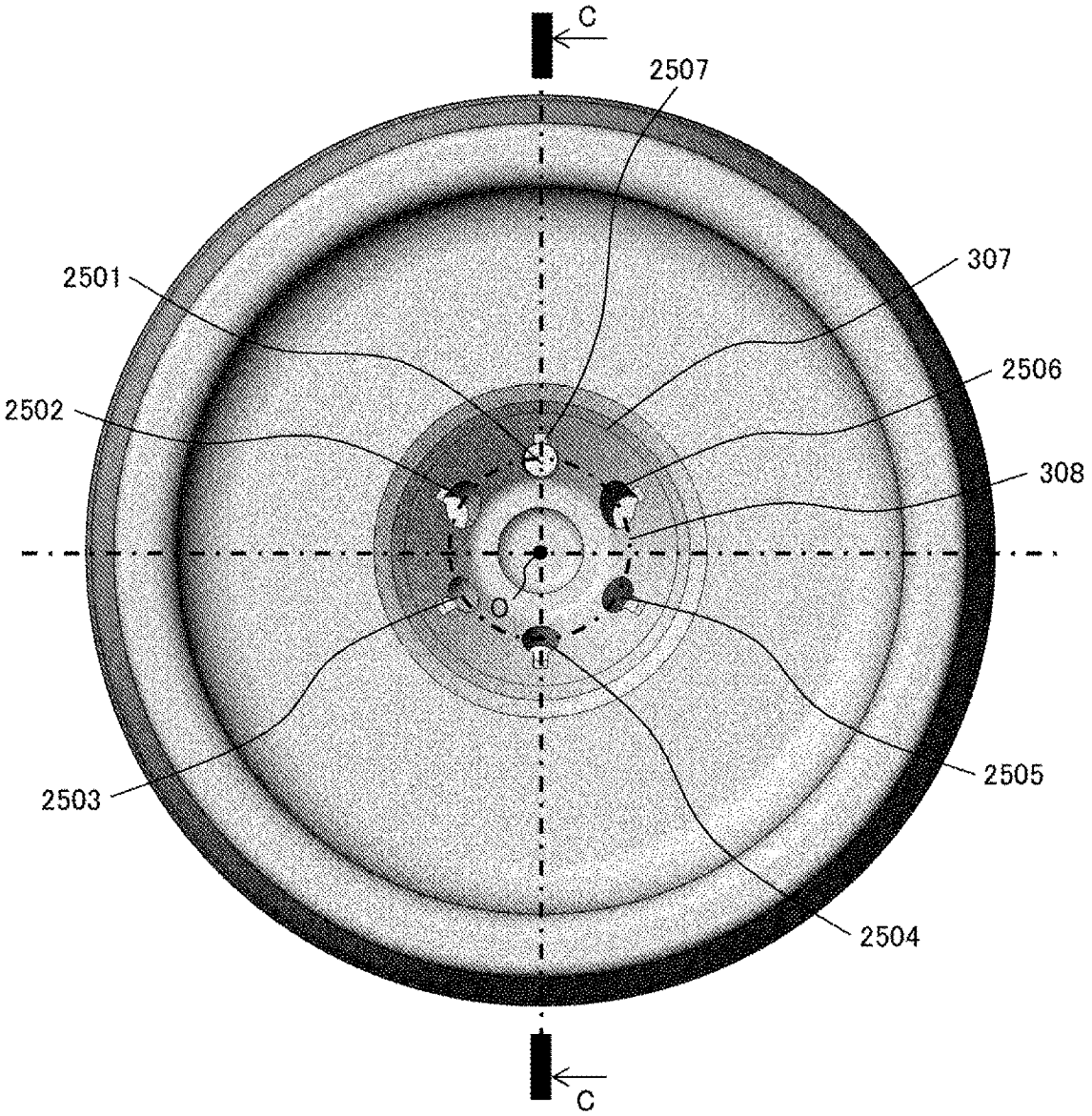
FIG. 24 is a plan view illustrating a configuration of an injection hole inlet according to the tenth embodiment.
Figure 25:
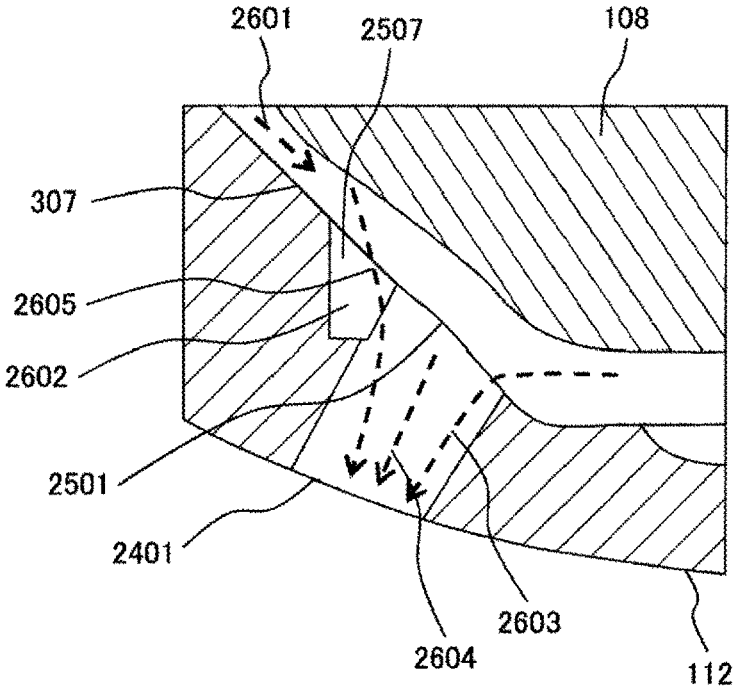
FIG. 25 is a cross-sectional view of an injection hole according to the tenth embodiment.

Next, a tenth embodiment will be described with reference to FIGS. 23 to 25. FIG. 23 is a plan view illustrating a configuration of an injection hole outlet according to the tenth embodiment. FIG. 24 is a plan view illustrating a configuration of an injection hole inlet according to the tenth embodiment. FIG. 25 is a cross-sectional view of an injection hole according to the tenth embodiment.

FIG. 23 illustrates injection hole outlets 2401 to 2406 of the fuel injection valve 101, which is similar to FIG. 3. FIG. 24 illustrates injection hole inlets 2501 to 2506, which is similar to FIG. 3. In the following description, the injection holes are designated using reference signs 2501, 2502, 2503, 2504, 2505, and 2506 of the injection hole inlets. For example, an injection hole having the injection hole inlet 2501 and the injection hole outlet 2401 will be described as the injection hole 2501.

In the present embodiment, a concave fuel passage (concave portion) 2507 is connected to each of the injection hole inlets 2501 to 2506 in order to ensure expansion of the injection hole inlet toward the seat portion 307 as a characteristic configuration. In the present embodiment, the injection hole inlets 2501 to 2506 and the injection hole outlets 2401 to 2406 are formed to have a circular cross section. The concave fuel passage 2507 is connected to each of the injection hole inlets 2501 to 2506 from the seat portion 307 side with respect to the injection hole inlets 2501 to 2506. The concave fuel passage 2507 does not penetrate through the nozzle member 112, and the injection hole outlets 2401 to 2406 have a circular shape. As a result, the injection hole inlets 2501 to 2506 are formed in a shape having a long axis and a short axis in the present embodiment.

Since the concave portion 2507 is connected to each of the injection hole inlets 2501 to 2506, the injection hole inlets 2501 to 2506 expand toward the seat portion 307, and high-pressure fuel can be guided to the injection holes 2501 to 2506.

This will be described in detail with reference to FIG. 25. FIG. 25 illustrates a cross section similar to that of FIG. 5 according to the first embodiment. Reference sign 2601 denotes fuel flow on the upstream side of the seat portion 307, and a fuel pressure is higher on the upstream side of the seat portion 307 than on the downstream side of the seat portion 307. Reference sign 2602 denotes an example of flow of fuel that flows to the injection hole inlet 2501 after passing through the seat portion 307 and flows toward the injection hole outlet 2401. Reference sign 2603 denotes flow from the center side of the fuel injection valve 101 (nozzle member 112) toward the injection hole outlet 2401 through the injection hole inlet 2501. Fuel flow 2604 indicates flow in which the fuel flow 2602 and the fuel flow 2603 merge with each other.

The upstream flow 2601 is accompanied by a pressure loss in a flow path toward the seat portion 307 and the injection hole inlet 2501, but the pressure loss that the fuel receives after passing through the seat portion 307 can be reduced since the fuel passage 2602 communicating with the injection hole inlet 2501 is configured to expand the injection hole inlet 2501 toward the seat portion 307. Further, although the fuel flow 2603 from the center side of the nozzle member 112 has undergone a large pressure loss to be decreased in pressure, the fuel flow 2604 in which the fuel flow 2603 and the fuel flow 2601 merge with each other is kept at a relatively high pressure since the fuel flow 2601 is at a high pressure. Thus, a pressure in the injection hole can be kept high, and thus, it is possible to obtain the same effect as in the first embodiment. Further, since the fuel passage 2602 is provided at the injection hole inlets 2501 to 2506, it is unnecessary to change the shape on the side of the injection hole outlets 2401 to 2406, and it is possible to enhance a rectifying effect in the injection hole.

According to the respective embodiments described above of the present invention, it is unnecessary to form a round chamfered portion at an opening edge of the injection hole inlet, and it is possible to prevent deterioration of the degree of freedom in manufacturing, such as complicated processing of the injection hole and a restriction of a processing method.

It is conceivable that at least the injection hole inlet is formed in an oval shape, a rectangular shape, or an elliptical shape as a specific shape having a long axis and a short axis in the embodiments according to the present invention, but the injection hole outlet may also be formed in an oval shape, a rectangular shape, or an elliptical shape.

Incidentally, the present invention is not limited to the respective embodiments described above, and includes various modifications. For example, the above-described embodiments have been described in detail in order to describe the present invention in an easily understandable manner, and are not necessarily limited to one including the entire configuration thereof. Further, some configurations of a certain embodiment can be substituted by configurations of another embodiment, and further, a configuration of another embodiment can be also added to a configuration of a certain embodiment. Further, addition, deletion or substitution of other configurations can be made with respect to some configurations of each embodiment.

REFERENCE SIGNS LIST

102 valve body
104 core
107 plurality of fuel injection holes
108 valve
109 anchor
110 spring
112 seat member (nozzle member)
113 seat portion
114 solenoid
307 seat portion
601 injection hole inlet
602 long axis of injection hole inlet 601
603 short axis of injection hole inlet 601
604 intersection of long axis 602 and short axis 603 of injection hole inlet
605 point of injection hole inlet closest to seat portion
606 point of seat portion closest to the injection hole inlet
607 line segment connecting 604 and 606
608 line segment obtained by projecting line segment 607 onto virtual plane including long axis 602 and short axis 603
609 side wall of injection hole
610 injection hole outlet
611 long axis of injection hole outlet
612 short axis of injection hole outlet

The invention claimed is:

1. A fuel injection valve for a gasoline engine, the fuel injection valve comprising:

a plurality of injection holes; and a valve and a seat portion that opens and closes a fuel passage to the plurality of injection holes in cooperation with each other, wherein at least one fuel injection hole among the plurality of injection holes is configured in a shape such that an injection hole inlet has a long axis and a short axis, and the long axis is directed in a direction in which an extension line intersects with the seat portion.

2. The fuel injection valve according to claim 1, wherein the seat portion and the plurality of injection holes are configured in a nozzle member, and when the injection hole inlet is projected on a virtual plane perpendicular to a central axis of the fuel injection valve, an angle formed by the long axis and a radial direction of the nozzle member is 50° or smaller.

3. The fuel injection valve according to claim 2, wherein an injection hole inlet has a long axis and a short axis intersecting each other in all of the plurality of injection holes, and when a vertical line from an upstream side to a downstream side of the fuel injection valve is projected onto an upstream injection hole surface, the angle formed by the long axis and the radial direction of the nozzle member is 0°.

4. The fuel injection valve according to claim 3, wherein the angle formed by the long axis and the radial direction of the nozzle member is 0° in all of the plurality of injection holes.

5. The fuel injection valve according to claim 3, wherein an area of an injection hole outlet is smaller than an area of the injection hole inlet in all of the plurality of injection holes.

6. The fuel injection valve according to claim 1, wherein the injection hole is configured in a shape in which an injection hole outlet has a long axis and a short axis, and a length of the long axis of the injection hole outlet is shorter than a length of the long axis of the injection hole inlet, and a length of the short axis of the injection hole outlet is shorter than a length of the short axis of the injection hole inlet.

7. The fuel injection valve according to claim 6, wherein the injection hole outlet of the injection hole is formed in a circular shape.

8. The fuel injection valve according to claim 1, wherein centroids of injection hole inlets of at least two injection holes among the plurality of injection holes are arranged on an identical circle.

9. The fuel injection valve according to claim 1, wherein in a state of being attached to an internal combustion engine, a ratio of a long-axis length and a short-axis length (long-axis length/short-axis length) of an injection hole inlet of an injection hole directed toward a center of an upper surface of a piston is larger than a ratio of a long-axis length and a short-axis length (long-axis length/short-axis length) of an injection hole inlet of an injection hole directed toward a distal end of a spark plug, among the plurality of injection holes.

10. The fuel injection valve according to claim 1, wherein a length of the long axis of the injection hole inlet of the injection hole is three times or more than a length of the short axis.

11. The fuel injection valve according to claim 1, wherein the injection hole inlet is formed in an oval shape, a rectangular shape, or an elliptical shape.

* * * * *